US006311025B1

(12) United States Patent
Nagata et al.

(10) Patent No.: US 6,311,025 B1
(45) Date of Patent: Oct. 30, 2001

(54) INTERCHANGEABLE PART RECOGNIZING APPARATUS AND IMAGE FORMING APPARATUS

(75) Inventors: Kenichi Nagata, Nara; Toshihide Morimoto, Gose; Hisashi Kunihiro; Hideaki Hagihara, both of Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/630,906

(22) Filed: Aug. 2, 2000

(30) Foreign Application Priority Data

Aug. 3, 1999 (JP) ..... 11-220294
Oct. 8, 1999 (JP) ..... 11-283958

(51) Int. Cl.[7] ..... G03G 15/00
(52) U.S. Cl. ..... 399/12; 399/13
(58) Field of Search ..... 399/12, 13, 27, 399/28, 262; 340/825.34

(56) References Cited

U.S. PATENT DOCUMENTS 4,963,939 * 10/1990 Kurando et al. ..... 399/12
4,978,995 * 12/1990 Takahashi ..... 399/12
5,075,724 12/1991 Wada et al. .
5,761,566 * 6/1998 Suzuki et al. ..... 399/12

FOREIGN PATENT DOCUMENTS 59-145179 8/1984 (JP) .
2-61656 3/1990 (JP) .
5-147339 6/1993 (JP) .

* cited by examiner

*Primary Examiner*—William J. Royer
(74) *Attorney, Agent, or Firm*—Dike, Bronstein, Roberts Cushman IP Group; David G. Conlin; David A. Tucker

(57) ABSTRACT

To meet a main unit downsized and provided with a lot of functions and an interchangeable part made to be versatile by simplification of manufacturing work, thereby preventing increase of the manufacturing cost and decrease of practical utility. When a toner cartridge is mounted to a developing section, a detecting electrode contacts the surface of a first dielectric layer at a position opposed to a pattern electrode of a recognizing portion, and a return electrode of a detecting section contacts the surface of the first dielectric layer at a position opposed to an entire electrode of the recognizing portion. The first dielectric layer is interposed between the detecting electrode and the pattern electrode, and the first dielectric layer and a second dielectric layer are interposed between the return electrode and the entire electrode. When an AC voltage is applied from an AC power source to the detecting electrode, an AC current passes from the detecting electrode to the pattern electrode through the first dielectric layer. The AC current having passed to the pattern electrode passes to the entire electrode through the second dielectric layer, and returns to the return electrode after passing through the second dielectric layer and the first dielectric layer in this order.

28 Claims, 17 Drawing Sheets

ALPHABETICAL LETTERS

ARABIC NUMERALS

KATAKANA LETTERS

10

INTERCHANGEABLE PART RECOGNIZING APPARATUS AND IMAGE FORMING APPARATUS

BACKGROUND OF THE INVENTION

1. Field of the Invention

The present invention relates to an interchangeable part recognizing apparatus which recognizes a toner cartridge of a developing device used in an image forming apparatus such as a copier, facsimile or printer and a process cartridge removably formed on a main unit such as an image forming unit made by uniting part or the whole of an image forming apparatus, and an image forming apparatus which is equipped with the interchangeable part recognizing apparatus.

2. Description of the Related Art

In a main unit in which some parts are consumed when used, consumable articles are removably mounted to the main unit as interchangeable parts. For example, in an image forming apparatus such as a copier or a printer which consumes toner in an electrophotographic image forming process, a toner cartridge of a consumable article which contains toner is removably mounted as an interchangeable part at a predetermined position in the image forming apparatus of a main unit. In the case of being short of toner, the toner cartridge mounted to the image forming apparatus is replaced with a new toner cartridge, whereby toner is supplied.

In general, the kind of an interchangeable part such as a toner cartridge to be mounted is defined for every main unit such as an image forming apparatus. Interchangeable parts to be mounted are different when the manufacturers of main units are different, and there is a case where interchangeable parts to be mounted are different for every model even when the manufacturers of the main units are the same. In such a case, when a different kind of interchangeable part from an interchangeable part to be mounted is mounted to a main unit, the main unit does not work properly. Therefore, in order to maintain a proper working state of a main unit, a suitable kind of interchangeable part for the main unit needs to be mounted.

Thus, conventionally, a variety of configurations for judging whether an interchangeable part mounted to a main unit is suitable or not have been proposed. For example, Japanese Examined Patent Publication JP-B2 3-33512 (1991) discloses a configuration of disposing a mark for visually identifying a genuine part to the outer wall of a replenishing and interchanging part of office equipment, forming the mark with an electrode or a member subjected to a magnetic or optical process which can convert to electric signals, and disposing a plurality of detecting members which detect the electrode or the member subjected to a magnetic or optical process forming the mark to a main unit of the equipment, thereby causing the equipment to work only in the case where desired detection signals are obtained from the plurality of detecting members.

Further, Japanese Unexamined Patent Publication JP-A 2-61656 (1990) discloses a configuration of disposing an article display portion of a specific pattern to an interchangeable article and disposing a detecting device which detects the specific pattern of the article display portion of the interchangeable article to an apparatus to which the interchangeable article is mounted.

Furthermore, Japanese Examined Patent Publication JP-B2 2786764 discloses a configuration of three-dimensionally forming marks of a specific shape which are fitted in each other at a position of attaching a consumable part in a main unit and on an attachment surface of a consumable part, disposing an electric signal member which generates electric signals representing the kind of a consumable part to a side surface forming the outline of a mark of a consumable part, disposing a detecting member which detects electric signals generated by the electric signal member to a side surface forming the outline of the mark of the main unit, and disposing first storing means which stores electric signals for every kind of consumable part, second storing means which stores processing operations for a single kind of consumable part or plural kinds of consumable parts, searching means which searches electric signals from the first storing means, and processing operation reading out means which reads processing operations to be executed out of the second storing means, to the main unit.

However, the conventional configurations have such a problem that a mark and pattern of an interchangeable part mounted to a main unit cannot be detected accurately as a main unit is downsized and provided with a lot of functions and manufacturing work of interchangeable parts is simplified.

That is to say, although JP-B2 3-33512 and JP-A 2-61656 disclose a configuration of detecting a mark and pattern represented on an interchangeable part mounted to a main unit and disabling an operation of the main unit in the case where the detection result is not proper, these inventions do not disclose a configuration for detecting the mark and pattern more reliably and specific contents of information obtained from the result of detecting the mark and pattern. For this reason, in the case where the area of a mark and pattern is reduced as a main unit and an interchangeable part are downsized, it is impossible to distinguish the difference in the detection results due to the difference of marks and patterns from errors of the detection results. As a result, it cannot be accurately judged from the detection results whether a proper interchangeable part is mounted or not.

Further, since the invention disclosed in JP-B2 3-33512 and JP-A 2-61656 have a configuration of only detecting a mark and a pattern, the amount of information on an interchangeable part obtained from the detection result is little. For this reason, with an interchangeable part which becomes versatile as manufacturing work is simplified, in the case where the content of an operation in a main unit needs to be changed in accordance with the kind of interchangeable part, enough information to change the operation content cannot be obtained from the detection result. Therefore, the main unit automatically sets the content of an operation in accordance with a mounted interchangeable part, and an operation cannot be started immediately after replacement of an interchangeable part. This problem is caused not only in the case of using a versatile interchangeable part suitable for plural models of main units in such a case that a single toner cartridge can be mounted to plural models of copiers, but also in the case of using plural kinds of interchangeable parts in a single model of main unit in a case such that a plurality of toner cartridges containing different colors of toners can be mounted to a single copier.

On the other hand, since a mark and detecting means are three-dimensionally formed so as to be fitted in each other in the invention disclosed in JP-B2 2786764, manufacturing work is complicated, the manufacturing cost rises, and fitness of interchangeable parts is worse, with the result that a problem of poor practical utility is caused. Further, in the case of using capacitance as electric signals detected from a mark, it is difficult to strictly keep accuracy of thickness of a dielectric layer of a three-dimensional mark. Thus, there is a problem of raising the manufacturing cost and promoting decrease of practical utility.

SUMMARY OF THE INVENTION

An object of the invention is to enable detection of an abundance of information from a visually recognizable mark represented on an interchangeable part, thereby providing an interchangeable part recognizing apparatus which can meet a main unit downsized and provided with a lot of functions and a versatile interchangeable part accompanying simplification of manufacturing work, and which does not raise the manufacturing cost or lower practical utility.

The invention has the following configurations as means for solving the above problems.

The invention provides an interchangeable part recognizing apparatus, comprising a recognizing portion formed on a surface of an interchangeable part which is removably mounted to a main unit, for displaying information on the interchangeable part, and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode; and an electric signal at the time of applying the AC voltage of the AC power source to the recognizing portion via the detecting electrode is detected as information on the interchangeable part.

In this configuration, the pattern electrode which is formed into a specific plane shape and covered by light-transmitting dielectric layers is disposed on the surface of an interchangeable part via an entire electrode. When the interchangeable part is mounted to a main unit, the detecting electrode is electrically connected to the dielectric layer located on the top surface of the pattern electrode, and a return electrode is electrically connected to the entire electrode. That is to say, when the interchangeable part is mounted to a main unit, an electric circuit through the AC power source, the detecting electrode, the dielectric layers, the pattern electrode, the entire electrode and the return electrode is formed. When an AC voltage is applied from the AC power source to the detecting electrode, electric signals responsive to capacitance which is proportional to the opposed area between the pattern electrode and the detecting electrode and the relative dielectric constant of the dielectric layers and inversely proportional to the thickness of the dielectric layers are detected via the return electrode.

Therefore, the user can easily judge whether or not an interchangeable part is suitable for the main unit by visually recognizing the plane shape of the pattern electrode through the light-transmitting dielectric layers, whereby it is prevented to mount a wrong interchangeable part. Further, the recognizing portion composed of the entire electrode, the pattern electrode and the dielectric layers is formed into a plane shape. Therefore, the detecting section reliably and intimately contacts the recognizing portion, electric signals of the recognizing portion are reliably detected by the detecting section, it becomes easy to highly accurately keep the thickness of the dielectric layers which defines capacitance having an influence on the electric signals, and operation of removing an interchangeable part from the main unit is facilitated. Furthermore, since the pattern electrode and the dielectric layers having an influence on electric signals detected by the detecting section are electrically shielded from the surface of an interchangeable part by the entire electrode, an influence of noise against electric signals detected by the detecting section from the recognizing portion is prevented. In addition, by changing the plane shape of the pattern electrode, information by electric signals is easily changed with visually recognized information.

Here, a state where the detecting electrode is electrically connected to the recognizing portion is a state where input and output of electric signals is allowed between the detecting electrode and the recognizing portion, which state is not limited to a case where the detecting electrode and the recognizing portion are connected to each other directly or via an electric conductor.

In the interchangeable part recognizing apparatus of the invention, it is preferable that the pattern electrode is of a specific shape including an ideographic shape having a predetermined logo mark or letter, formed into a plane shape which is the same in basic shape regardless of a kind of the interchangeable part and different in area depending on the kind of the interchangeable part.

In this configuration, the recognizing portion which includes a pattern electrode being the same in basic shape regardless of the kind of the interchangeable part and different in area depending the kind of the interchangeable part. Therefore, even in the case where the pattern electrode of the same basic shape including an ideographic shape such as a trademark of a manufacturer is formed on different kinds of interchangeable parts, different electric signals are detected from the respective interchangeable parts. As a result, it is possible to distinguish the kind of a mounted interchangeable part by information based on the electric signals detected by the detecting section in a main unit.

Further, for each of a plurality of kinds of interchangeable parts having common characteristics is formed a recognizing portion which is a pattern electrode of a plane shape such as a letter which is the same in basic shape and different in line width. Therefore, the same information is visually recognized from recognizing portions formed on different kinds of interchangeable parts. Further, since the areas of the pattern electrodes formed on the respective interchangeable parts are different, different electric signals for the respective parts are detected. For this reason, for example, by forming pattern electrodes which have a shape of a trademark having a function of displaying the source as a plane shape on plural kinds of interchangeable parts of the same manufacturer, and changing the line widths of the pattern electrodes for every kind, it is possible to visually recognize that the plural kinds of interchangeable parts having the same trademark as the pattern electrodes are products of the same manufacturer, and distinguish the kinds of the respective interchangeable parts based on electric signals detected by the detecting sections from the respective recognizing portions.

The invention provides an interchangeable part recognizing apparatus, comprising a recognizing portion formed on a surface of an interchangeable part which is removably mounted to a main unit, for displaying information on the interchangeable part, and a detecting section for reading the information from the recognizing portion of the interchangeable part mounted to the main unit, wherein the recognizing portion includes a pattern electrode having a plane shape, which is composed of at least one segment made effective selectively from among a plurality of segments of identical or different shape, an entire electrode which is located between a surface of the interchangeable part and the pattern electrode and extended in a wider range than the pattern electrode, and a light-transmitting dielectric layer which covers the entire top surface of the pattern electrode and at least a part of a top surface of the entire electrode, the part being opposed to the pattern electrode;

the detecting section has a shape corresponding to the plane shape of the pattern electrode, and includes a detecting electrode which is electrically connected to the recognizing portion, and an AC power source which applies an AC voltage to the detecting electrode; and an electric signal at the time of applying the AC voltage of the AC power source to the recognizing portion via the detecting electrode is detected as information on the interchangeable part.

In this configuration, a plane shape of pattern electrode formed on the surface of an interchangeable part is composed of a combination of a plurality of segments placed at predetermined positions. Therefore, by preparing a versatile pattern electrode composed of a plurality of segments placed at predetermined positions, and eliminating segments other than a segment to be effective, it is possible to easily form pattern electrodes of various kinds of plane shapes.

In the interchangeable part recognizing apparatus of the invention, it is preferable that the pattern electrode has a plane ideographic shape having a predetermined logo mark or letter, which ideographic plane shape is composed of at least one segment selected from among a plurality of segments of identical or different shape and made effective.

In this configuration, the recognizing portion provided with a pattern electrode having a plane ideographic shape which is composed of at least one segment selected from among a plurality of segments of identical or different shape and made effective is formed on the interchangeable part. Therefore, the recognizing portion having a highly visible shape is easily formed on the interchangeable part.

In the interchangeable part recognizing apparatus of the invention, it is preferable that the pattern electrode has a plane shape which is composed of at least one segment of seven segments constituting a letter of "8".

In this configuration, any segment of seven segments constituting the letter of "8" is selectively made effective to form the plane shape of the pattern electrode. Therefore, a segment to be made effective is selected to represent a plane shape of an alphabetical letter, an Arabic numeral or the like, and plural kinds of ideographic letters are created with ease by using a versatile pattern electrode.

In the interchangeable part recognizing apparatus of the invention, it is preferable that the pattern electrode has a plane ideographic shape including a predetermined logo mark or letter as a specific shape, which plane ideographic shape is composed of at least one segment of seven segments constituting a letter of "8".

In this configuration, the recognizing portion provided with a pattern electrode having an ideographic shape composed of at least one segment of seven segments constituting the letter of "8" as a plane shape is formed on an interchangeable part. Therefore, the recognizing portion having a highly visible shape is formed on an interchangeable part still more easily.

In the interchangeable part recognizing apparatus of the invention, it is preferable that the dielectric layer is composed of a first dielectric layer which covers the top surface of the pattern electrode and a second dielectric layer which is placed between the entire electrode and the pattern electrode.

In this configuration, in the recognizing portion formed on the surface of an interchangeable part, the dielectric layers are formed on the top surface of the pattern electrode, and between the pattern electrode and the entire electrode. Therefore, capacitance is detected still more accurately by the detecting electrode, and the pattern electrode and the dielectric layers are electrically shielded from the surface of the interchangeable part by the entire electrode with reliability.

In the interchangeable part recognizing apparatus of the invention, it is preferable that the detecting section includes a return electrode which has a shape to surround the periphery of the detecting electrode.

In this configuration, the return electrode opposed to the top surface of the entire electrode is formed into the shape to surround the periphery of the detecting electrode opposed to the top surface of the pattern electrode. Therefore, the pattern electrode and the dielectric layers are electrically shielded from the surface of the interchangeable part by the entire electrode in the recognizing portion with reliability.

In the interchangeable part recognizing apparatus of the invention, it is preferable that the return electrode is electrically connected to the entire electrode directly or via the dielectric layers.

In this configuration, in the case of connecting the return electrode to the entire electrode via the dielectric layers, it is possible to input and output electric signals between the return electrode and the entire electrode without changing the configuration of the recognizing portion. In the case of directly connecting the return electrode to the entire electrode, it is possible to increase a shield effect by the entire electrode still more.

In the interchangeable part recognizing apparatus of the invention, it is preferable that the detecting electrode is divided into a plurality of portions associated with the plane shape of the pattern electrode.

In this configuration, the detecting electrode divided into a plurality of portions associated with the plane shape of the pattern electrode is opposed to the top surface of the pattern electrode. Therefore, by detecting electric signals from the recognizing portion for every divided portion of the detecting electrode, electric signals associated with the respective shapes of a plurality of portions of the pattern electrodes to which the respective portions of the detecting electrode oppose are detected. As a result, the accuracy of distinguishing an interchangeable part based on the shape of the pattern electrode is increased.

The interchangeable part recognizing apparatus of the invention further comprises a comparing section for comparing electric signals detected by the plurality of portions of the detecting electrode.

In this configuration, electric signals detected from the recognizing portion via the plurality of portions of the detecting section are compared by the comparing section. Therefore, it is possible to relatively judge whether the plurality of detected electric signals are proper or not, and it is possible to prevent that errors of electric signals caused at detection are offset and an interchangeable part is mistakenly recognized.

In the interchangeable part recognizing apparatus of the invention, it is preferable that the detecting section alternately applies an AC voltage to two portions divided in the detecting electrode and, during application of an AC voltage to one of the two portions, detects electric signals via the other portion to which an AC voltage is not applied.

In this configuration, an AC voltage is alternately applied to two portions of the detecting electrode, and electric signals are detected twice in different directions from a single electric passage in the detecting section and the recognizing portion. Therefore, by comparing the results of detecting electric signals twice, errors of the relative dielectric constant, thickness or the like of the dielectric layers are offset, and electric signals are detected more accurately.

In the interchangeable part recognizing apparatus of the invention, it is preferable that the return electrode is a reference surface of constant area.

In this configuration, even in the case where errors of the relative dielectric constant and errors of the thickness are caused in the dielectric layers of the recognizing portion, it is possible to reduce influences by these errors and increase the accuracy of detecting electric signals.

In the interchangeable part recognizing apparatus of the invention, it is preferable that the AC power source includes frequency changing means which changes the frequency of an AC voltage applied to the detecting electrode.

In this configuration, it is possible to apply various frequencies of AC voltages from the AC power source to the detecting electrode on detection of electric signals from the detecting section. Therefore, by forming the dielectric layers of the recognizing portion with materials having different frequency characteristics in accordance with the kinds of interchangeable parts, the interchangeable parts are distinguished more accurately.

In the interchangeable part recognizing apparatus of the invention, it is preferable that the detecting electrode is elastically supported and contacts the recognizing portion.

In this configuration, the detecting section and the recognizing portion are pressed against each other by an elastic member. Therefore, intimate contact of the recognizing portion and the detecting section is secured, whereby electric signals are detected more accurately.

In the interchangeable part recognizing apparatus of the invention, it is preferable that the detecting electrode itself is elastic.

In this configuration, the detecting electrode itself forming the detecting section is elastic, so that it is possible to press the detecting section against the recognizing portion without using an extra elastic member.

In the interchangeable part recognizing apparatus of the invention, it is preferable that the detecting electrode is formed by using an electrically conductive rubber as a material.

In this configuration, it is possible to use an electrically conductive rubber and form the detecting electrode itself as an electrode having elasticity with ease.

In the interchangeable part recognizing apparatus of the invention, it is preferable that the main unit includes a storing section in which a relationship between electric signals to be detected by the detecting section and information on a processing operation to be executed by the main unit for each of plural kinds of interchangeable parts which can be mounted to the main unit is stored, and a searching section which searches, in the storing section, a processing operation corresponding to electric signals detected from the recognizing portion by the detecting section.

In this configuration, the processing operation corresponding to electric signals detected from the recognizing portion by the detecting section is searched in the storing section by the searching section. Therefore, in addition to information on every interchangeable part obtained from electric signals detected from the recognizing portion by the detecting section, information on a processing operation of every interchangeable part in the main unit stored in the storing section is specified, and more information can be obtained for every interchangeable part. As a result, it is possible to not only judge whether an interchangeable part mounted to the main unit is suitable or not, but also, in the case where plural kinds of interchangeable parts can be selectively mounted to a single mounting section of the main unit, accurately execute a processing operation associated with the mounted interchangeable part.

The invention provides an image forming apparatus which is provided with the interchangeable part recognizing apparatus.

In this configuration, information on a part mounted to an image forming section of an image forming apparatus is detected as an electric signal from the recognizing portion formed on the surface of the part, via the detecting section. Therefore, whether the kind of the part mounted to the image forming section of the image forming apparatus is suitable or not, and information on an image forming processing operation suitable for the mounted part are accurately detected. As a result, an image forming process after replacement of the part is accurately executed.

In the image forming apparatus of the invention, it is preferable that the interchangeable part recognizing apparatus uses a toner cartridge including a toner replenishing bottle as an interchangeable part.

In this configuration, the image forming apparatus is provided with an interchangeable part recognizing apparatus which uses a toner cartridge containing toner consumed in an image forming processing operation as an interchangeable part. Therefore, it is accurately recognized whether a toner cartridge with a toner replenishing bottle containing suitable toner for an image forming processing operation is mounted or not. Specifically it becomes easy to handle a toner cartridge in a color image forming apparatus using plural kinds of toners in an image forming process.

In the image forming apparatus of the invention, it is preferable that the interchangeable part recognizing apparatus uses, as an interchangeable part, a process cartridge which includes the photoconductor and at least one of the developing means, the charging means and the cleaning means constituting the image forming section.

In this configuration, the image forming apparatus is provided with an interchangeable part recognizing apparatus which uses, as an interchangeable part, a removably mounted process cartridge integrating the photoconductor and at least one of the developing means, the charging means and the cleaning means deteriorating over time in an image forming processing operation. Therefore, it becomes easy to handle a process cartridge which needs to be replaced due to deterioration over time in an image forming processing operation.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
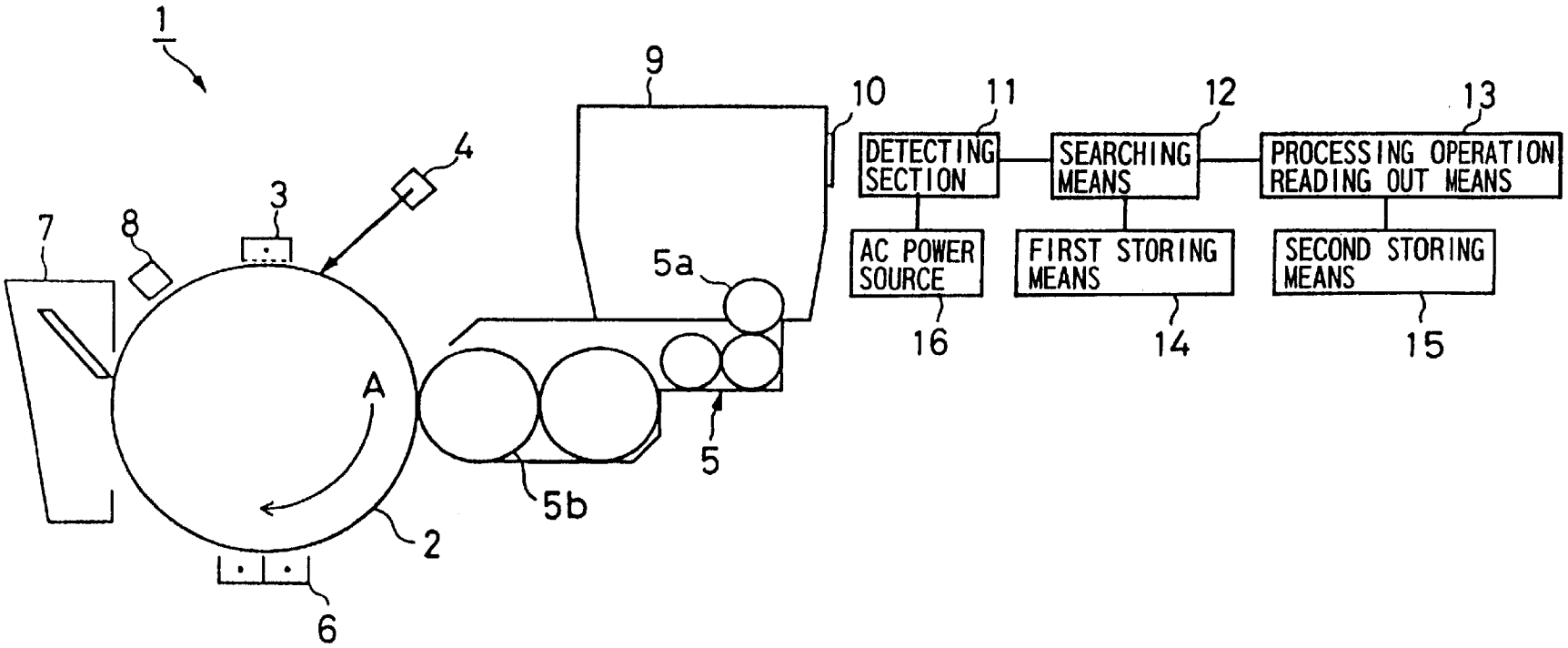
FIG. 1 is a view showing the main configuration of an image forming apparatus to which an interchangeable part recognizing apparatus of an embodiment of the invention is applied.

Now referring to the drawings, preferred embodiments of the invention a re described below.

An interchangeable part recognizing apparatus of an embodiment of the invention will be explained with an example of applying the apparatus to an image forming apparatus which functions as a main unit. FIG. 1 is a view showing the main configuration of an image forming apparatus to which the interchangeable part recognizing apparatus of the embodiment is applied. In an image forming section 1 of the image forming apparatus, around a photoconductor drum 2 which rotates in the direction of an arrow A, charging means 3, exposing means 4, developing means 5, transferring means 6, cleaning means 7 and discharging means 8 are placed in this order along the rotation direction of the photoconductor drum 2.

In the photoconductor drum 2 is formed a photoconductive layer which generates a photoconductive action, on the surface of a cylindrical base. The charging means 3 uniformly supplies single polarity of electric charge to the surface of the photoconductor drum 2. The exposing means 4 irradiates the surface of the photoconductor drum 2 with image light modulated by image data. Thus, an electrostatic latent image is formed on the surface of the photoconductor drum 2 by the photoconductive action of the photoconductive layer. The developing means 5 supplies toner to the surface of the photoconductor drum 2 on which an electrostatic latent image is formed, and changes the electrostatic latent image to a toner image. The transferring means 6 transfers the toner image held on the surface of the photoconductor drum 2 to the surface of a sheet of paper fed from a paper feeding section (not shown), in synchronization with rotation of the photoconductor drum 2. The cleaning means 7 eliminates toner and so on remaining on the surface of the photoconductor drum 2 after the transfer process. The discharging means 8 eliminates electric charge remaining on the surface of the photoconductor drum 2 after the transfer process. Here, the sheet of paper having been subjected to the transfer process is heated and pressurized by a fixing device (not shown), whereby the toner image is once melted and thereafter sturdily fixed to the surface of the sheet of paper.

In the image forming section 1, toner contained in the developing means 5 is consumed in an image forming process. Therefore, when the storage amount of toner in the developing means 5 decreases, the developing means 5 is replenished with toner contained in a toner cartridge 9 which is mounted to the top of the developing means 5, by rotation of a replenishing roller 5*a*. The replenished toner is conveyed to a developing roller 5*b* while being agitated in the developing means 5, and supplied to the surface of the photoconductor drum 2 via the peripheral surface of the developing roller 5*b*. When the toner in the toner cartridge 9 is run out, the developing means 5 cannot be replenished with toner. For this reason, the toner cartridge 9 is removably mounted to the top of the developing means 5. When the toner in the toner cartridge 9 mounted to the developing means 5 is run out, the toner cartridge 9 is detached from the top of the developing means 5, and a new toner cartridge 9 is mounted to the top of the developing means 5.

That is to say, the toner cartridge 9 is an interchangeable part in the invention, and a recognizing portion 10 is formed on one side surface of the toner cartridge 9. Further, in the image forming section 1, a detecting section 11 is placed at a position opposed to the recognizing portion 10 formed on the toner cartridge 9 mounted to the top of the developing means 5. The detecting section 11 is pressed against the surface of the recognizing portion 10 by a predetermined pressing force. Searching means 12 which functions as a searching section in the invention is connected to the detecting section 11. Processing operation read out means 13 is connected to the other side of the searching means 12. The searching means 12 has first storing means 14, and the processing operation read out means 13 has second storing means 15. The processing operation read out means 13 is connected to a not-shown control section which controls the operation of the respective elements constituting the image forming section 1.

The detecting section 11 receives an AC voltage applied from an AC power source 16, and applies the AC voltage to the recognizing portion 10. When receiving the AC voltage applied from the detecting section 11, the recognizing portion 10 outputs electric signals which represent the kind of a toner cartridge 9 on which the recognizing portion 10 is formed. The first storing means 14 stores the relations between electric signals to be detected from the recognizing portions 10 of a single kind or plural kinds of toner cartridges 9 which can be mounted to the developing means 5 of the image forming section 1, and the kinds of the toner cartridges 9. The searching means 12 searches the electric signals detected by the detecting section 11 and the kind of the toner cartridge 9 associated with the electric signals, in the first storing means 14. In the case where the electric signals detected by the detecting section 11 are stored in the first storing means 14 as electric signals of a toner cartridge 9 which can be mounted to the developing means 5, the kind of the toner cartridge 9 associated with the electric signals is inputted from the searching means 12 to the processing operation reading out means 13.

The second storing means 15 stores the relation between the kind of toner cartridge 9 and a processing operation to be executed in the image forming section 1. That is to say, in the case where plural kinds of toner cartridges 9 can be selectively mounted to the developing means 5 of the image forming section 1, there is a case where the content of a processing operation in the image forming section 1 such as the setting value of a developing bias voltage, a charging voltage or the like must be changed in accordance with the kind of a toner cartridge 9 mounted to the developing means 5. The second storing means 15 stores the content of the processing operation to be executed in the image forming section 1 for each of the kinds of toner cartridges 9. The processing operation read out means 13 reads the content of a processing operation associated with the kind of toner cartridge 9 inputted from the search means 12 out of the second storage means 15, and outputs the content to a control section (not shown). The control section controls the operation states of the respective elements constituting the image forming section 1 in accordance with the content associated with the kind of toner cartridge 9 mounted to the developing means 5 based on the content of the processing operation inputted from the processing operation read out means 13.

Figure 2:
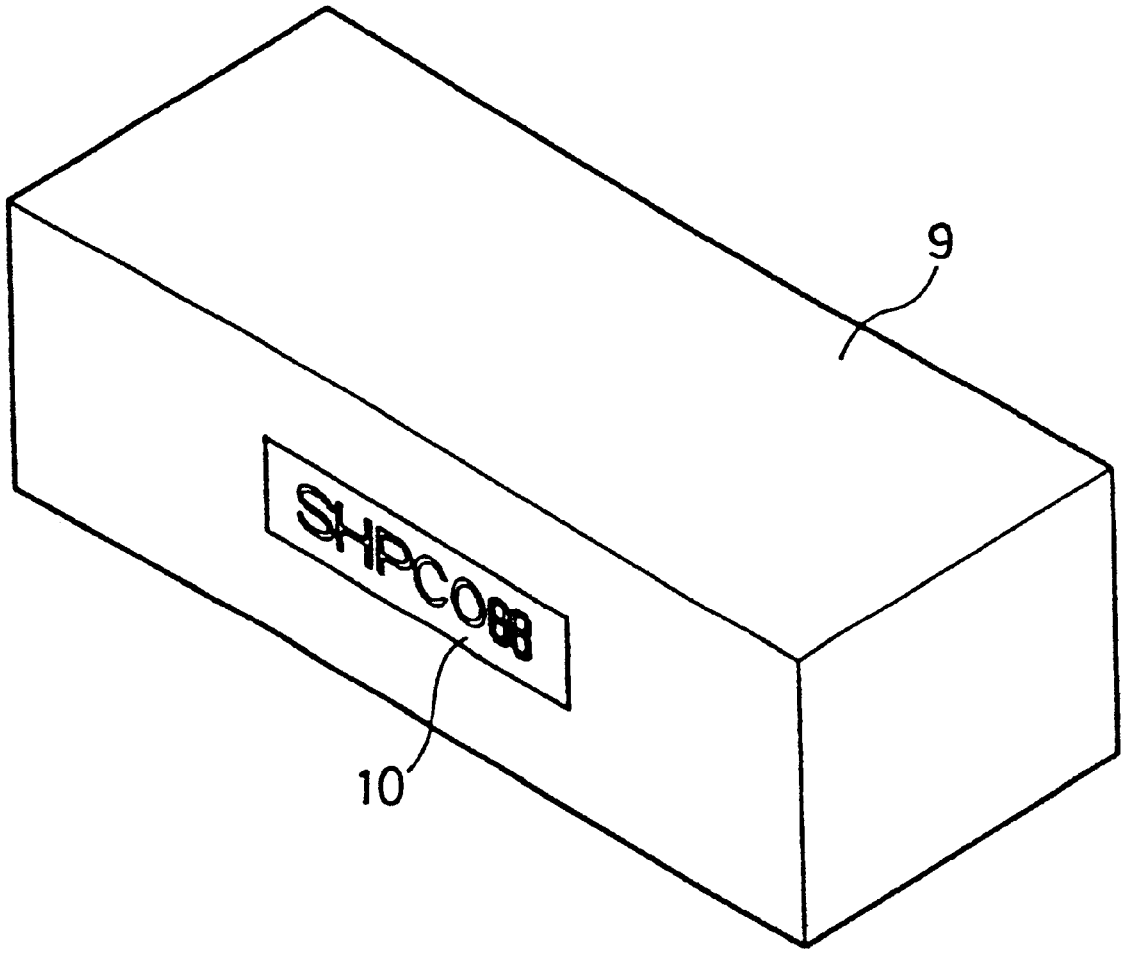
FIG. 2 is an external view of a toner cartridge mounted to an image forming section to which the interchangeable part recognizing apparatus is applied.
Figure 3A:
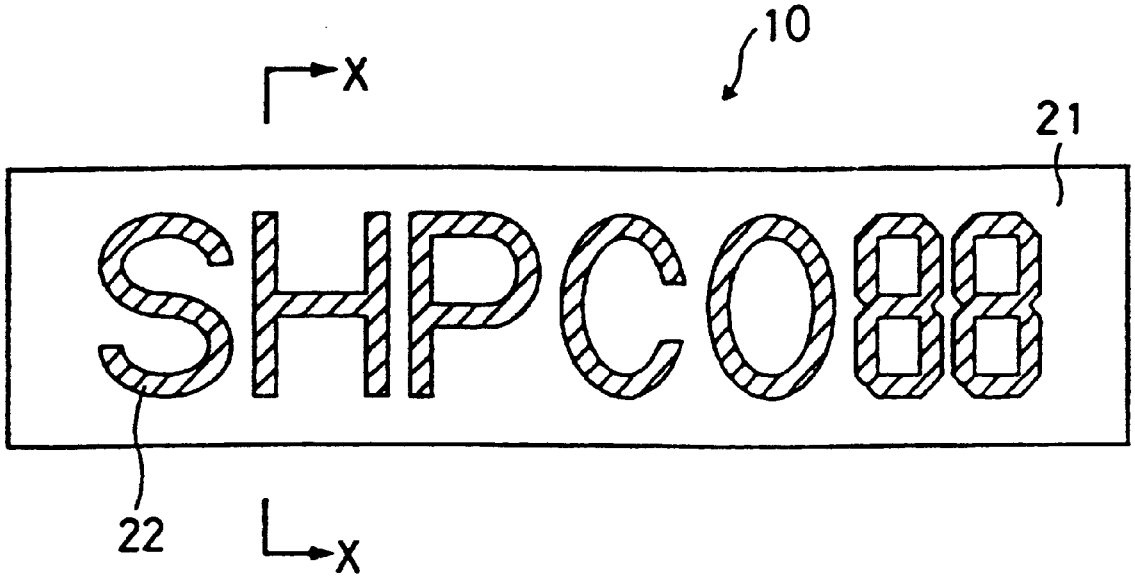
FIGS. 3A and 3B are a front view and a cross-section view showing the configuration of a recognizing portion formed on the surface of the toner cartridge.
Figure 3B:
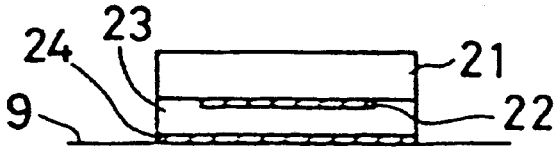

FIG. 2 is an external view of a toner cartridge mounted to an image forming section to which the interchangeable part recognizing apparatus is applied. Further, FIG. 3A is a front view showing the configuration of a recognizing portion which is formed on the surface of the toner cartridge, and FIG. 3B is a cross-section view taken on line X—X of FIG. 3A. On one side surface of a toner cartridge 9 which is removably mounted to the developing means 5 of the image forming section 1 as an interchangeable part of the invention, a recognizing portion 10 is formed. The recognizing portion 10 is made by stacking an entire electrode 24, a second dielectric layer 23, a pattern electrode 22 and a first dielectric layer 21 in this order on one side surface of the toner cartridge 9.

The pattern electrode 22 is made by forming an electrically conductive thin-film electrode into a plane shape which represents letters of "SHPCO88". The plane shape of the pattern electrode 22 can be an ideographic shape composed of arbitrary letters, pictures or symbols or a combination thereof which can be visually recognized by the user. In this example, the plane shape of the pattern electrode 22 is formed by a combination of a mark composed of five alphabetical letters of "SHPCO" representing the manufacturer of the toner cartridge 9 and a numeral of "88" representing the kind of the toner cartridge 9. A mark such as "SHPCO" is, for example, a trademark with the function of displaying the origin of the interchangeable part on which the recognizing portion 10 is formed. The user visually checks the mark displayed by the pattern electrode 22 on the recognizing portion of the toner cartridge 9, and thereby recognizes that the toner cartridge 9 is the one that can be mounted to the image forming section 1 of an image forming apparatus which is a main unit.

Figure 4:
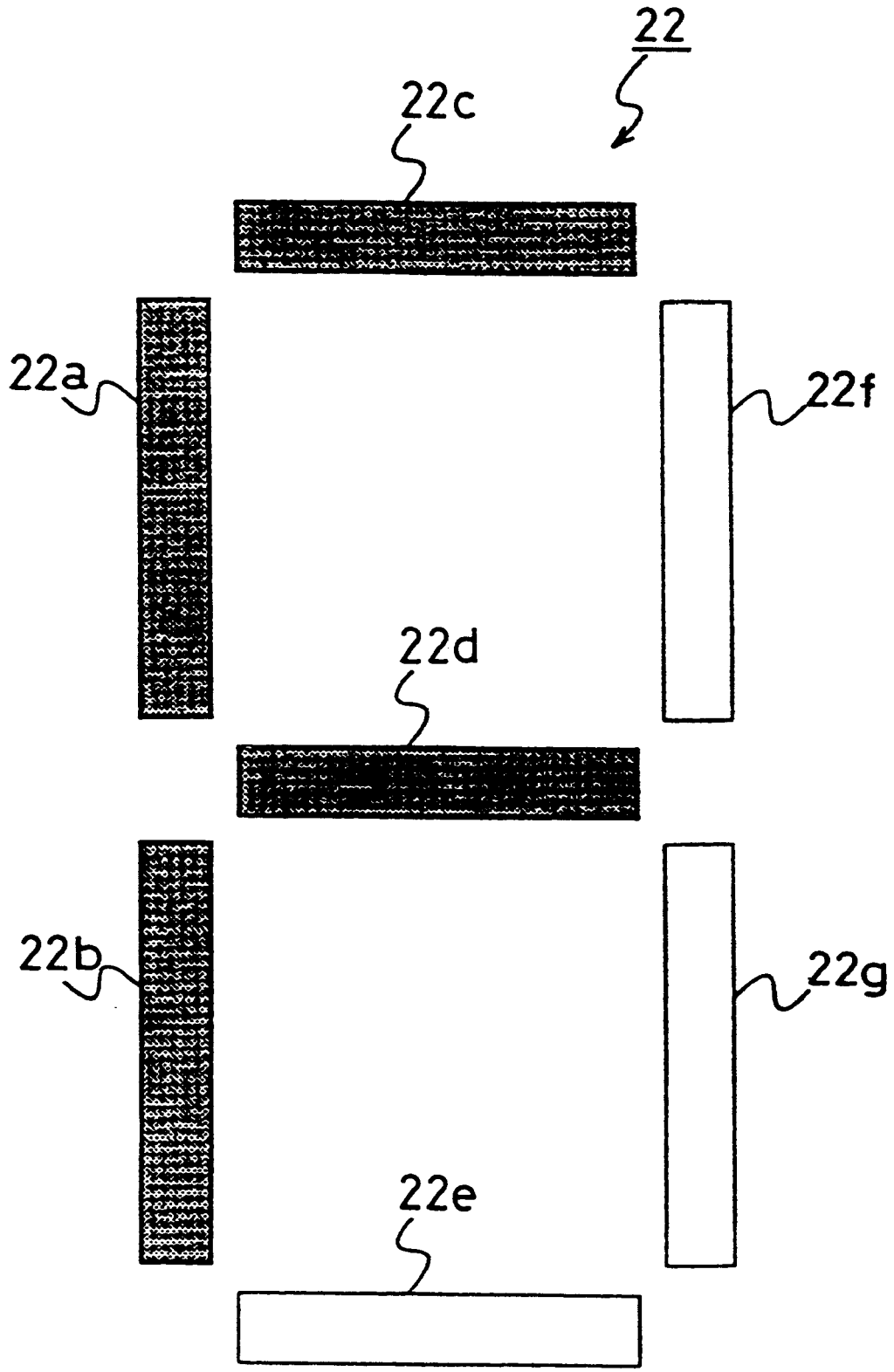
FIG. 4 is a view showing the plane shape of a pattern electrode which is a constituent of an interchangeable part recognizing apparatus of another embodiment of the invention.

FIG. 4 is a view showing another configuration of the pattern electrode. In this example, the pattern electrode 22 has a plane ideographic shape of alphabetical letters, Arabic numerals or the like by selectively combining segments to be made effective from among seven segments 22*a* to 22*g* placed at positions of forming a letter of "8". In the example shown in FIG. 4, the segments 22*a* to 22*d* are on and the segments 22*e* to 22*g* are off, whereby a plane shape of an alphabetical letter of "F" is formed.

Figure 5A:
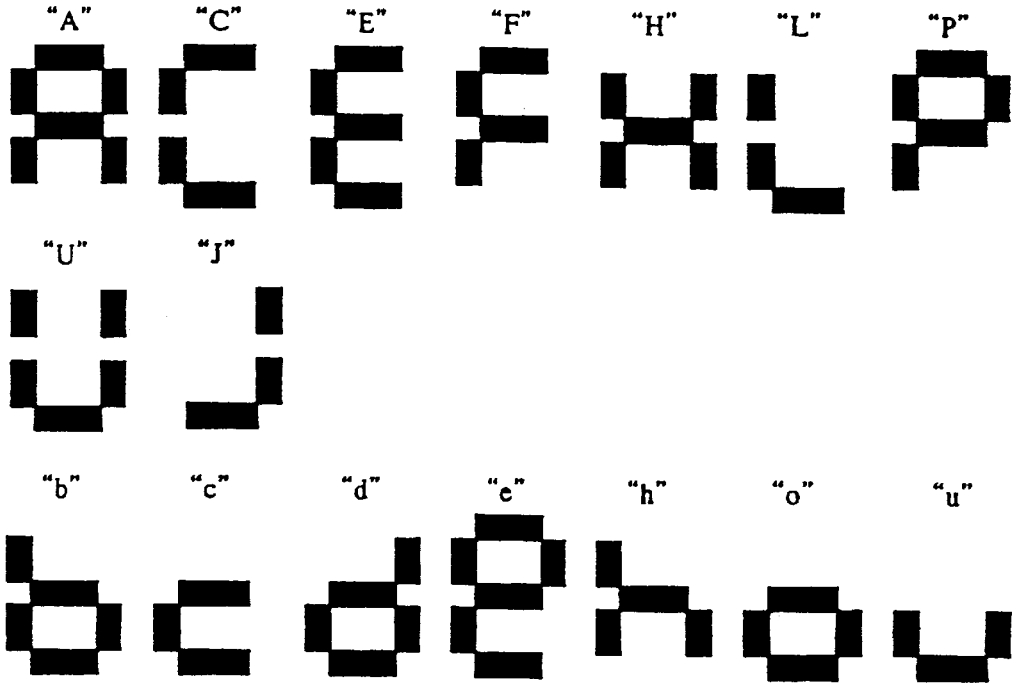
FIGS. 5A to 5C are views showing examples of forming the surface shape of the pattern electrode included in the interchangeable part recognizing apparatus with seven segments constituting a letter of "8"
Figure 5B:
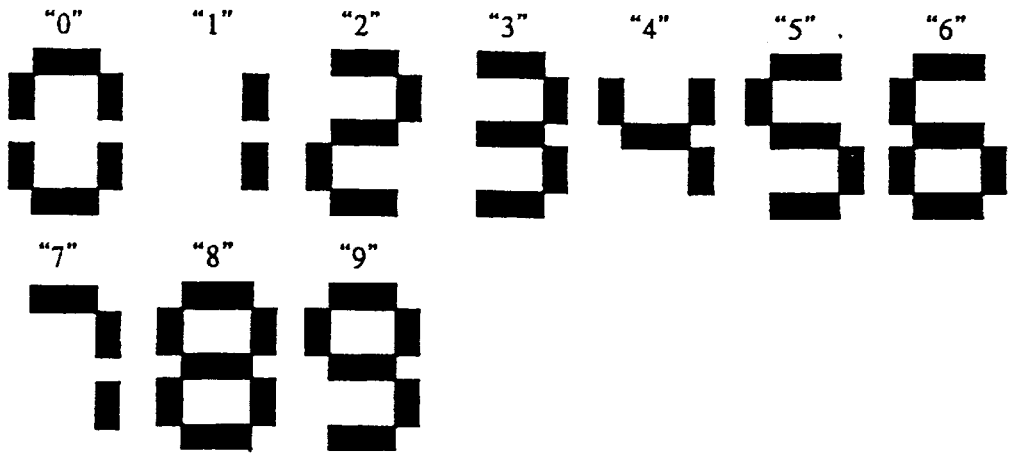
Figure 5C:
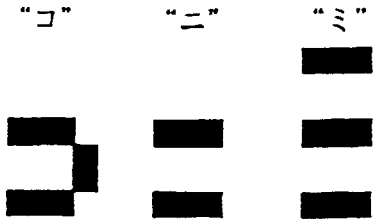
Figure 6:
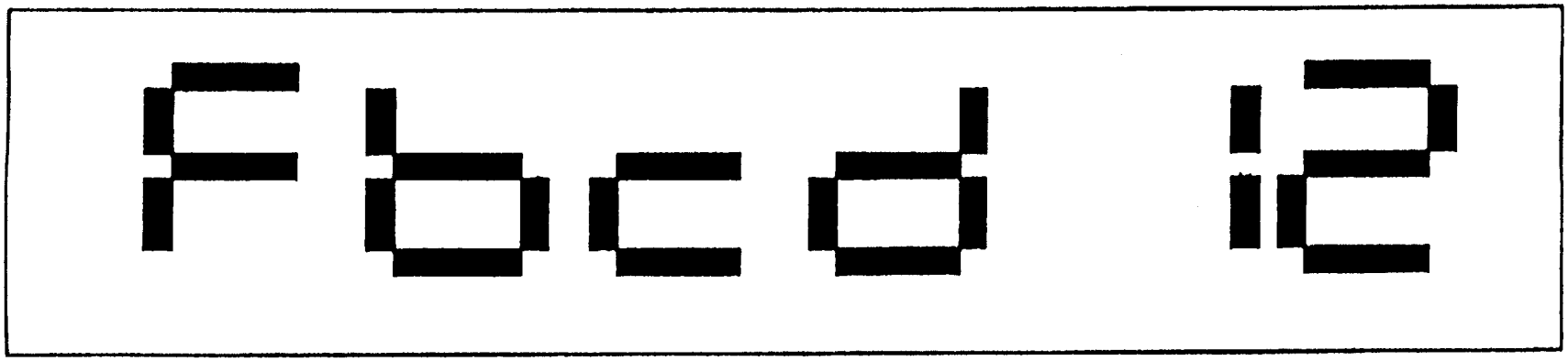
FIG. 6 is a view showing an example of the recognizing portion constituting the interchangeable part recognizing apparatus of the other embodiment.

By thus forming the plane shape of the pattern electrode 22 so as to represent an ideographic letter or the like by making at least one segment effective from among the seven segments constituting the letter of "8", it is possible to configure the pattern electrode 22 so as to have plural kinds of plane shapes by using a single kind of material composed of seven segments as shown in FIGS. 5A to 5C. Therefore, it is possible to standardize the material of the pattern electrode having different plane shapes, and simplify a manufacturing process. By combining a plurality of pattern electrodes having a plane shape thus composed of at least one segment of the seven segments, it is possible to form highly visible recognizing portions 10 on many kinds of interchangeable parts, respectively, as shown in FIG. 6.

As long as being a plurality of segments placed at predetermined specific positions, the segments are not limited to seven segments which compose the letter of "8".

Further, a plurality of segments constituting the pattern electrode can be formed into the same or different shape. Specifically, by setting electric characteristics such as electric capacity or frequency characteristics so as to be equal, a process of judging the kind of an interchangeable part becomes easy as mentioned later.

The first dielectric layer 21 covering the top surface of the pattern electrode 22 and the second dielectric layer 23 covering the top surface of the entire electrode 24 are made of, for example, a material which has flat frequency characteristics such as polystyrene, polyethylene terephthalate, polypropylene, polycarbonate or polyethylene, or a material which has nonflat frequency characteristics such as polyurethane. Since being formed on the top surface of the pattern electrode 22 which should be visible from outside, at least the first dielectric layer 21 needs to be light-transmitting. On the contrary, considering that the pattern electrode 22 located above the entire electrode 24 needs to be clearly visible from outside, the second dielectric layer 23 needs to have a color which is opaque and clearly different from that of the pattern electrode 22 in the case where the entire electrode 24 does not have a clearly different color from the pattern electrode 22. However, in the case where the entire electrode 24 has a clearly different color from the pattern electrode 22, it is possible to use the same material as the first dielectric layer 21. The thickness t of the first dielectric layer 21 and the second dielectric layer 23 is set to $t<10$ mm, preferably, $10\ \mu m<t<2$ mm. The relative dielectric constant of the first dielectric layer 21 and the second dielectric layer 23 is set to $\epsilon<20$, preferably, $1.5<\epsilon<5$.

The entire electrode 24, which is an electrically conductive thin-film electrode which is directly formed on one side surface of the toner cartridge 9, electrically shields the whole recognizing portion 10 from the surface of the toner cartridge 9 and prevents an effect of electric noise from the toner cartridge 9. The entire electrode 24 can be directly formed on the surface of the toner cartridge 9 by using a material such as nickel, aluminum or copper by a method such as evaporation or plating. Further, the entire electrode 24 can be made by bonding a metal thin plate stamped into a specific size and shape in a stamping process to the surface of the toner cartridge 9, or printing with conductive ink on the surface of the toner cartridge 9.

Figure 7A:
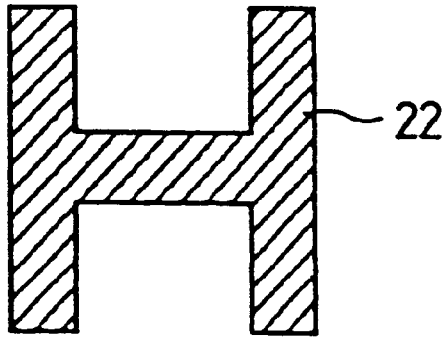
FIGS. 7A and 7B are views showing the configuration of a detecting section included in the interchangeable part recognizing apparatus of the other embodiment in comparison with the pattern electrode.
Figure 7B:
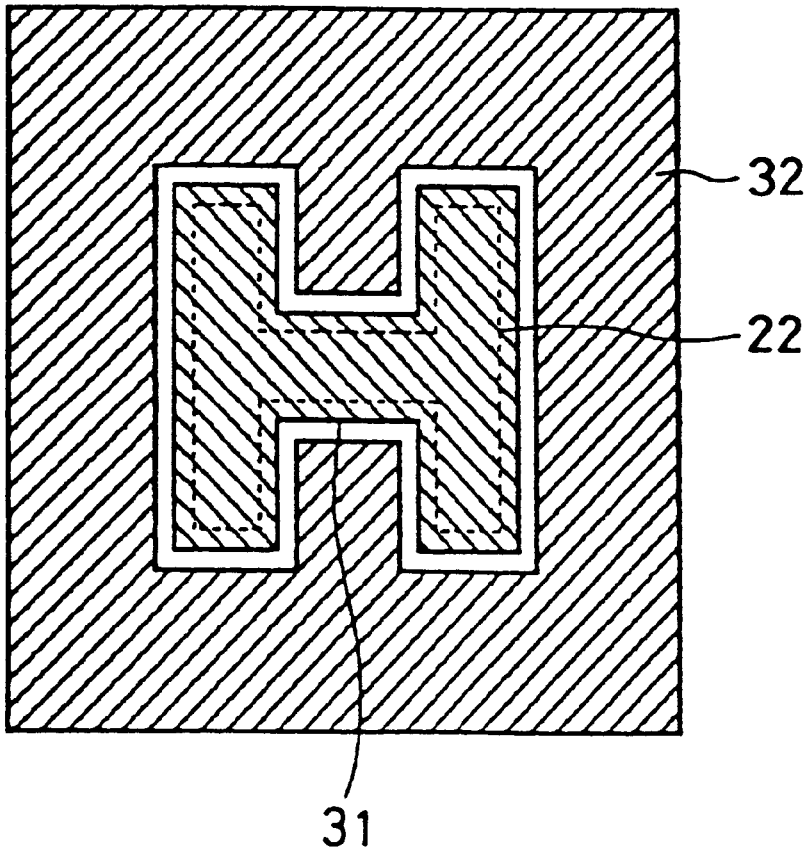

FIGS. 7A and 7B are views showing the configuration of a detecting section included in the interchangeable part recognizing apparatus, in comparison with a pattern electrode. The detecting section 11 of the interchangeable part recognizing apparatus of the invention is composed of a detecting electrode 31 and a return electrode 32 as shown in FIG. 7B. The plane shape of the detecting electrode 31 and the return electrode 32 is formed into a shape corresponding to the plane shape of the pattern electrode 22 included in the recognizing portion 10. Here, as shown in FIG. 7A, an example of forming the plane shape of the pattern electrode 22 into an alphabetical letter of "H" will be explained. In this case, the detecting electrode 31 has a plane shape representing a letter of "H" in the same manner as the plane shape of the pattern electrode 22. However, the width of lines constituting the letter in the shape of the detecting electrode 31 is wider than the width of lines constituting the letter in the shape of the pattern electrode 22. This is for ensuring to oppose the detecting electrode 31 to the whole surface of the pattern electrode 22. On the other hand, the plane surface of the return electrode 32 is formed so as to surround the detecting electrode 31 with a predetermined gap from the detecting electrode 31 along the whole perimeter of the peripheral portion of the detecting electrode 31.

The detecting electrode 31 is connected to the AC power source 16, whereby an AC voltage from the AC power source 16 is applied thereto on detection of electric signals from the recognizing portion 10. Further, the return electrode 32 is grounded via a voltage detecting circuit.

Figure 8:
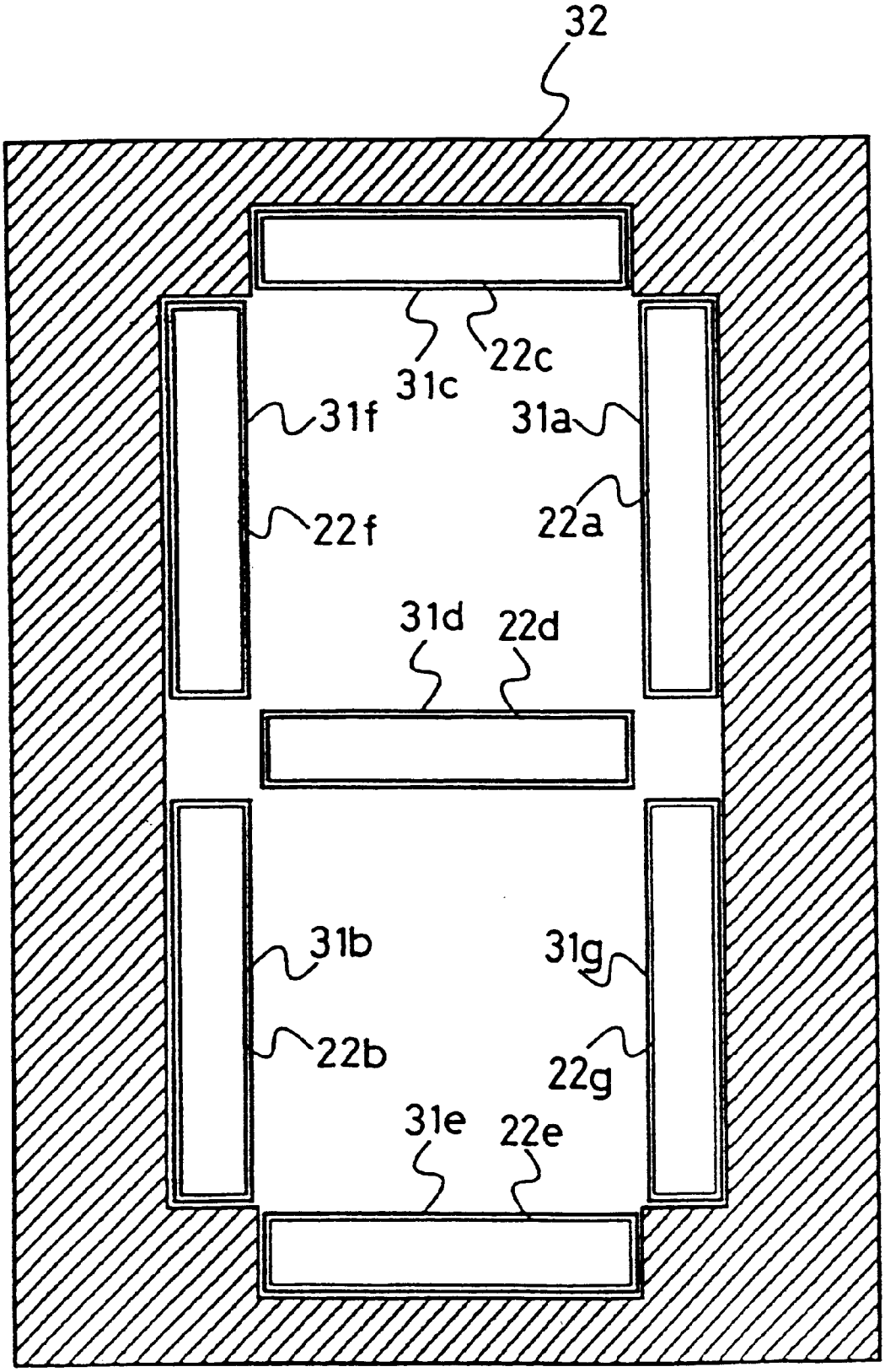
FIG. 8 is a view showing the configuration of the detecting electrode constituting the interchangeable part recognizing apparatus of the other embodiment.

Further, in the case where the pattern electrode 22 is formed by a combination of the seven segments 22*a* to 22*g* split at specific positions as shown in FIG. 4, the detecting electrode 31 is composed of seven segments 31*a* to 31*g* placed at positions opposed to the seven segments 22*a* to 22*g* of the pattern electrode 22, respectively, as shown in FIG. 8. The segments 31*a* to 31*g* are formed so as to have larger areas than the respective segments of the pattern electrode 22. As a result, the detecting electrode 31 can contact the whole surface of one or more segments among the seven segments 22*a* to 22*g* constituting the plane shape of the pattern electrode 22. Further, the return electrode 32 is formed outside a range surrounded by the seven segments 31*a* to 31*g*.

Figure 9:
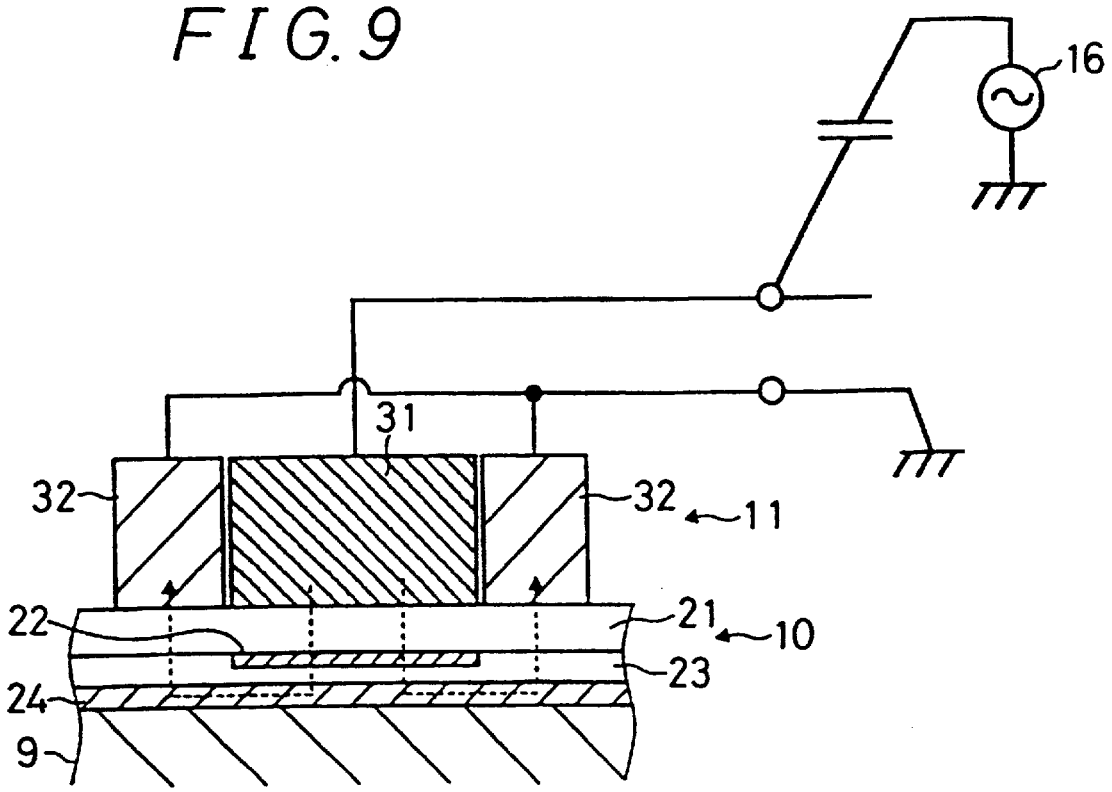
FIG. 9 is a view explaining a state of detecting electric signals from the recognizing portion by the detecting section in the interchangeable part recognizing apparatus.

FIG. 9 is a view explaining the state where the detecting section detects electric signals from the recognizing portion in the interchangeable part recognizing apparatus. When the toner cartridge 9 is mounted to the developing means 5 of the image forming section 1, the detecting section 11 contacts the surface of the recognizing portion 10 formed on the toner cartridge 9. At this moment, the detecting electrode 31 of the detecting section 11 contacts the surface of the first dielectric layer 21 at a position opposed to the pattern electrode 22 of the recognizing portion 10, and the return electrode 32 of the detecting section 11 contacts the surface of the first dielectric layer 21 at a position opposed to the entire electrode 24 of the recognizing portion 10. Therefore, such a state is kept that the first dielectric layer 21 is interposed between the detecting electrode 31 and the pattern electrode 22 and the first dielectric layer 21 and the second dielectric layer 23 are interposed between the return electrode 32 and the entire electrode 24.

When an AC voltage is applied from the AC power source 16 to the detecting electrode 31 in this state, an AC current passes from the detecting electrode 31 to the pattern electrode 22 via the first dielectric layer 21. The AC current having passed to the pattern electrode 22 passes to the entire electrode 24 via the second dielectric layer 23, and then returns to the return electrode 32 after passing through the second dielectric layer 23 and the first dielectric layer 21 in this order. By measuring the value of a current generated at the first dielectric layer 21 and returning to the return electrode 32 in this way, a capacitance C of the first dielectric layer located between the detecting electrode 31 and the pattern electrode 22 is detected as electric signals. Here, since the return electrode 32 is electrically connected to the entire electrode 24 via the first dielectric layer 21 and the second dielectric layer 23, it is possible to increase an electric shield effect against the toner cartridge 9 by the entire electrode 24. Therefore, it is possible to prevent misdetection of electric signals with reliability.

Figure 10:
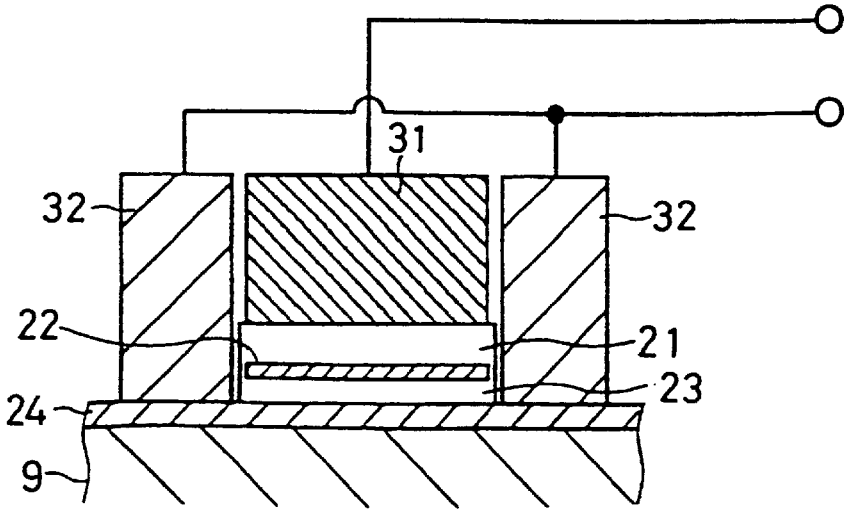
FIG. 10 is a view showing another configuration of the detecting section and the recognizing portion included in the interchangeable part recognizing apparatus.

On condition that the pattern electrode 22 is not electrically connected to the return electrode 32, as shown in FIG. 10, the first dielectric layer 21 and the second dielectric layer 23 may not locate at a portion which is not opposed to the pattern electrode 22 on the top surface of the entire electrode 24 so that the return electrode 32 directly contacts the entire electrode 24. With this configuration, it is possible to increase a shield effect against the toner cartridge 9 by the entire electrode 24 still more.

Further, as electric signals detected from the recognizing portion 10, it is possible to detect a voltage value between the detecting electrode 31 and the return electrode 32, instead of the value of a current passing to the return electrode 32.

Furthermore, a current value and voltage value detected by the detecting section 11 as electric signals of the recognizing portion 10 change in accordance with the area of the pattern electrode 22. The area of the pattern electrode 22 changes by changing the width of lines of a letter forming a plane shape even in the case where the plane shape is geometrically identical. For example, in the case where the plane shape of the pattern electrode 22 is an alphabetical letter of "H" as shown in FIGS. 11A and 11B, a pattern electrode 22' shown in FIG. 11B in which the width of lines constituting "H" is one half of that of the pattern electrode 22 shown in FIG. 11A has an area about one half of that of the pattern electrode 22.

Figure 11A:
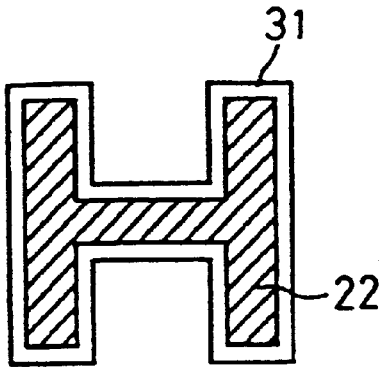
FIGS. 11A to 11F are views showing an opposed state between the detecting section and the recognizing portion included in the interchangeable part recognizing apparatus.

That is to say, a capacitance C' of the first dielectric layer 21 located between the pattern electrode 22' and the detecting electrode 31 is one half of a capacitance C of the first dielectric layer 21 located between the pattern electrode 22 and the detecting electrode 31 shown in FIG. 11A. Therefore, by changing the width of lines of a letter or the like represented by the plane shape of the pattern electrode 22, it is possible to change electric signals detected by the detecting section 11 from the recognizing portion 10.

Thus, in the case of changing only the width of lines of a letter or the like represented by the plane shape of the pattern electrode 22, the basic shape of the plane shape itself of the pattern electrode 22 does not change. As a result, the content of a letter or the like visually recognized by the user from the plane shape of the pattern electrode 22 in the recognizing portion 10 would not change. Therefore, in the case where plural kinds of toner cartridges 9 can be mounted to the developing means 5 of a single image forming section 1, only the width of lines of the pattern electrode of the recognizing portion 10 formed on the toner cartridge 9 is changed for each kind, whereby it is possible to change only information electrically detected from the recognizing portion 10 by the detecting section 11, without changing information visually recognized from the recognizing portion 10 by the user.

According to this, the user can easily know that a plurality of kinds of toner cartridges 9 provided with pattern electrodes 22 of identical plane shape but of different line width are supplied from the same manufacturer, based on information visually recognized from the recognizing portion 10. Moreover, the control section can easily judge the kind of toner cartridge 9 mounted to the developing means 5, based on information electrically detected from the recognizing portion 10. This configuration can be applied to plural kinds of toner cartridges 9 containing different colors, for example.

Figure 11D:
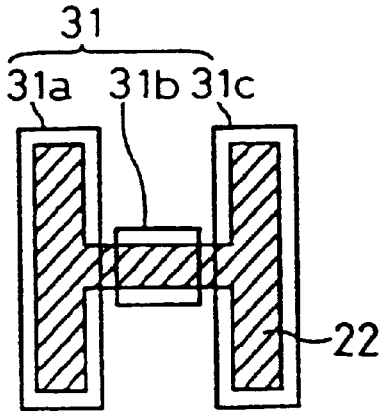
Figure 11B:
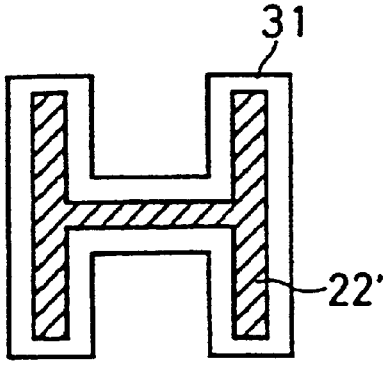
Figure 11E:
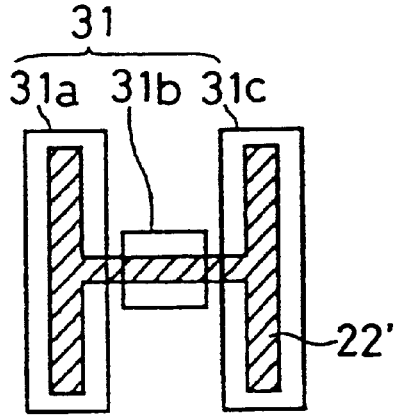
Figure 11C:
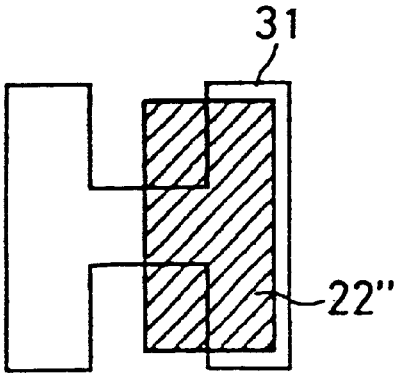

However, in the case where the detecting section 11 has a single detecting electrode 31 opposed to the whole of one plane shape of the pattern electrode 22, an opposed area to a pattern electrode 22" having a plane basic shape of an alphabetical letter of "I" as shown in FIG. 11C becomes almost one half of an opposed area to the pattern electrodes 22 and 22' having a basic shape of an alphabetical letter of "H" as shown in FIGS. 11A and 11B. Although the basic shapes are different, the pattern electrode 22' shown in FIG. 11B and the pattern electrode 22" shown in FIG. 11C become equivalent regarding electric signals. As a result, such a problem occurs that a toner cartridge 9 on which pattern electrode 22" is formed is misjudged for a toner cartridge 9 on which the pattern electrode 22' is formed.

As shown in FIGS. 11D and 11E, by forming the detecting electrode 31 with partial electrodes 31*a* to 31*c* which are electrically separated from each other, and judging the kind of a toner cartridge 9 based on the results of detecting electric signals by the respective partial electrodes 31*a* to 31*c*, it is possible to prevent misdetection of the cartridge 9.

That is to say, in the case of the pattern electrodes 22 and 22' having a basic shape of an alphabetical letter "H", the respective partial electrodes 31*a* to 31*c* contact portions corresponding to the respective shapes of "I", "-" and "I" of the pattern electrodes 22 and 22' on the first dielectric layer 21. Therefore, the detecting section 11 detects electric signals associated with a capacitance one half of that of electric signals detected from the recognizing portion 10 including the pattern electrode 22 shown in FIG. 11D, from the recognizing portion 10 including the pattern electrode 22' shown in FIG. 11E, via the respective partial electrodes 31*a* to 31*c*.

Figure 11F:
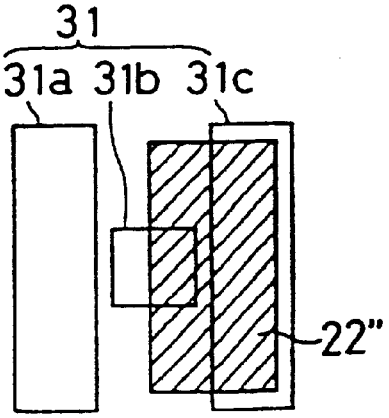

On the other hand, as shown in FIG. 11F, in the case of the pattern electrode 22" having a basic shape of an alphabetical letter "I", the partial electrode 31*a* is not opposed to the pattern electrode 22", the partial electrode 31*b* is opposed to the pattern electrode 22" in a region of almost one half, and the partial electrode 31*c* is opposed to the pattern electrode 22" in a region of almost the whole. Therefore, the detecting section 11 does not detect electric signals via the partial electrode 31*a*. The detecting section detects electric signals associated with a capacitance one half of that of electric signals detected from the recognizing portion 10 including the pattern electrode 22 shown in FIG. 11D (electric signals almost the same as electric signals detected from the recognizing portion 10 including the pattern electrode 22' shown in FIG. 11E), via the partial electrode 31*b*. The detecting section detects electric signals almost the same as electric signals detected from the recognizing portion 10 including the pattern electrode 22 shown in FIG. 11D, via the partial electrode 31*c*.

Thus, the detecting section 11 detects different electric signals via the partial electrode 31*a* and 31*c* in the case of being opposed to the pattern electrode 22' shown in FIG. 11E, from electric signals in the case of being opposed to the pattern electrode 22" shown in FIG. 11F. Therefore, the detecting section can accurately distinguish a toner cartridge 9 provided with a recognizing portion 10 including the pattern electrode 22' from a toner cartridge 9 provided with a recognizing portion 10 including the pattern electrode 22", and would not make a misdetection.

Figure 12A:
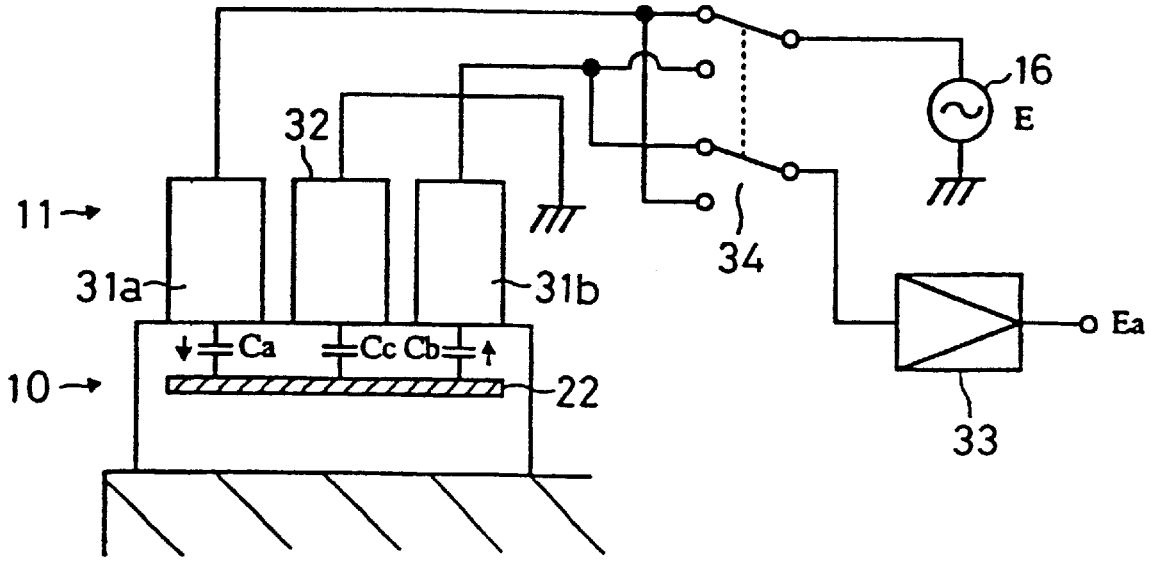
FIGS. 12A and 12B are views showing the configuration of the detecting section in the case of constituting a detecting electrode with a plurality of partial electrodes.
Figure 12B:
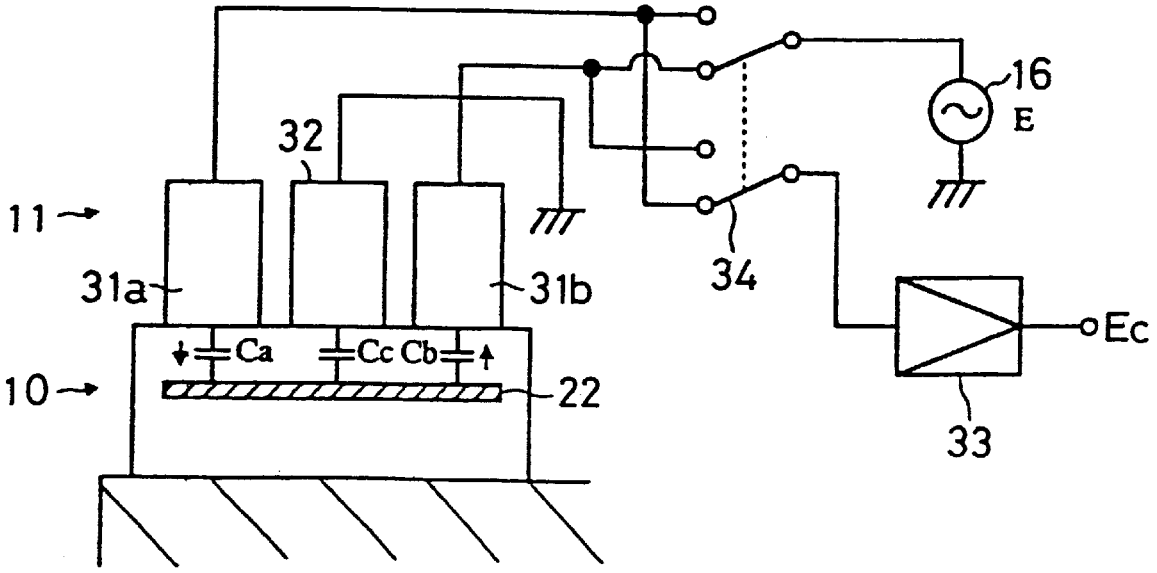

FIGS. 12A and 12B are views showing the configuration of a detecting section in the case where a detecting electrode is composed of a plurality of partial electrodes. The detecting section 11 shown in FIGS. 12A and 12B has the detecting electrode 31 composed of partial electrodes 31*a* and 31*b* and the return electrode 32. For convenience of explanation, the second dielectric layer 23 and the entire electrode 24 of the recognizing portion 10 are not shown. In this configuration, a switching section 34 is disposed, which selectively switches the partial electrode 31*a* and the partial electrode 31*b*, thereby connecting one to the AC power source 16 and connecting the other to amplifier 33. When the detecting section 11 with this configuration contacts the surface of the recognizing portion 10, capacitances Ca to Cc are generated, respectively, at portions opposed to the partial electrode 31 a, the partial electrode 31*b* and the electrode 32 in the recognizing portion 10.

Figure 13A:
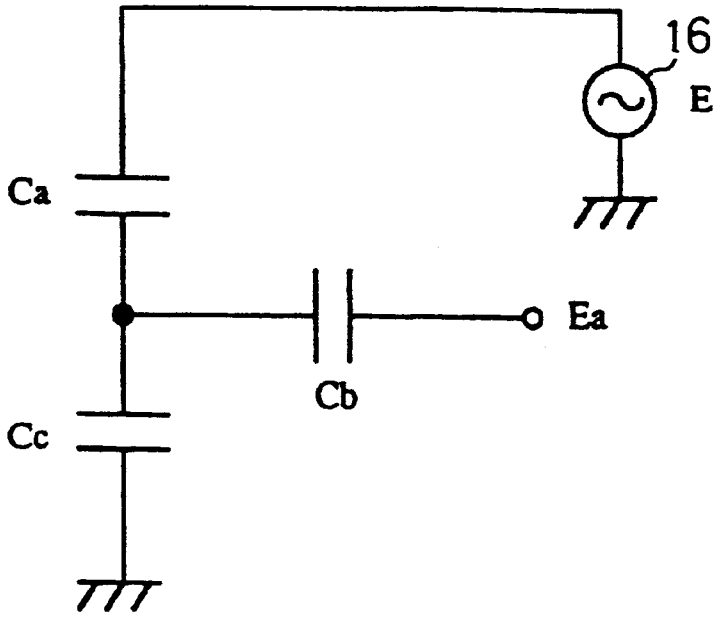
FIGS. 13A and 13B are views showing equivalent circuits of the detecting section in FIGS. 12A and 12B.

In a state where the switching section 34 connects the partial electrode 31*a* to the AC power source 16 and connects the partial electrode 31*b* to the amplifier 33 as shown in FIG. 12A, a detection voltage Ea detected by the amplifier 33 is calculated by:

$$Ea=\{Cc/(Ca+Cc)\}\cdot E \tag{1}$$

wherein an AC voltage applied from the AC power source 16 is denoted by E, as shown in a circuit of FIG. 13A.

Figure 13B:
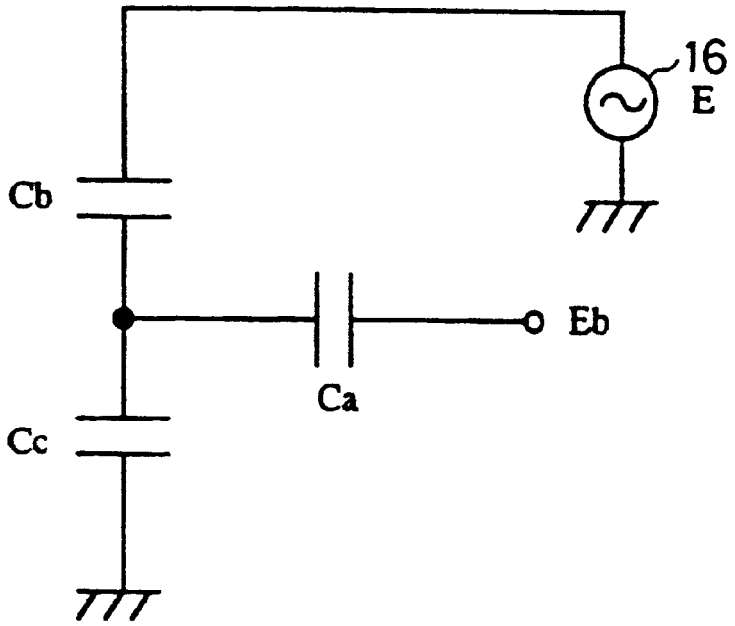

On the contrary, in a state where the switching section 34 connects the partial electrode 31*b* to the AC power source 16 and connects the partial electrode 31*a* to the amplifier 33 as shown in FIG. 12B, a detection voltage Eb detected by the amplifier 33 is calculated by:

$$Eb=\{Cc/(Cb+Cc)\}\cdot E \tag{2}$$

as shown in a circuit of FIG. 13B.

Figure 14:
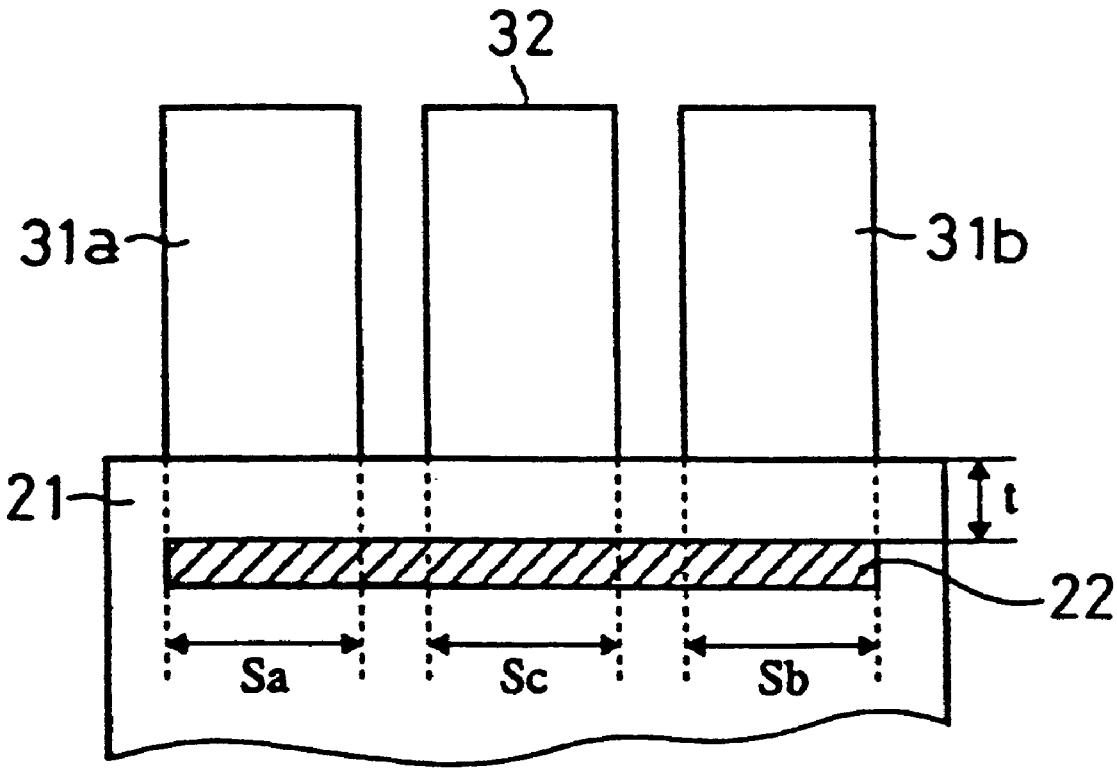
FIG. 14 is a view explaining the relationship among areas, capacitances, relative dielectric constants and thicknesses of portions opposed to partial electrodes and a return electrode in a pattern electrode.
Figure 15:
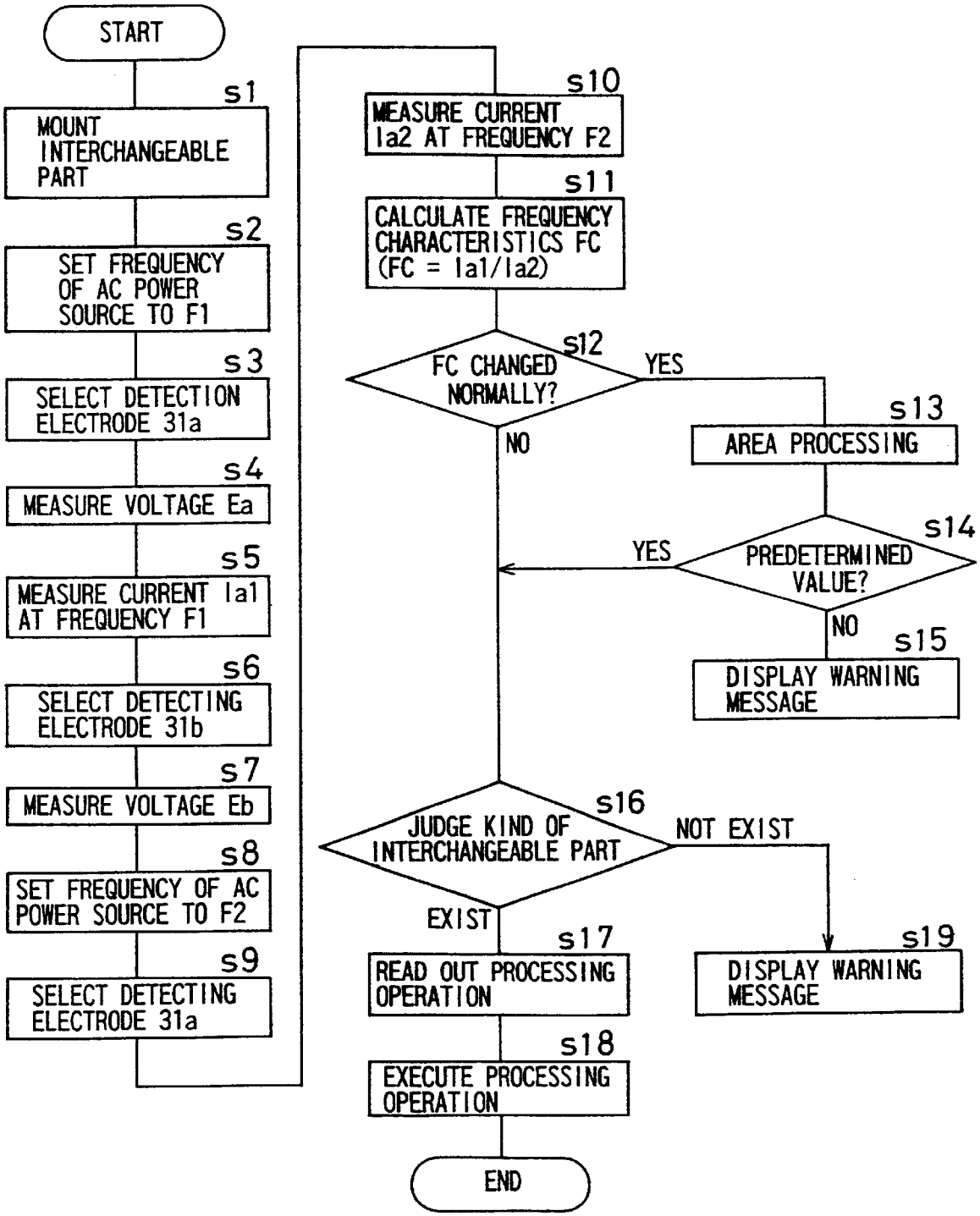
FIG. 15 is a flow chart showing processing steps in the interchangeable part recognizing apparatus.
Figure 16A:
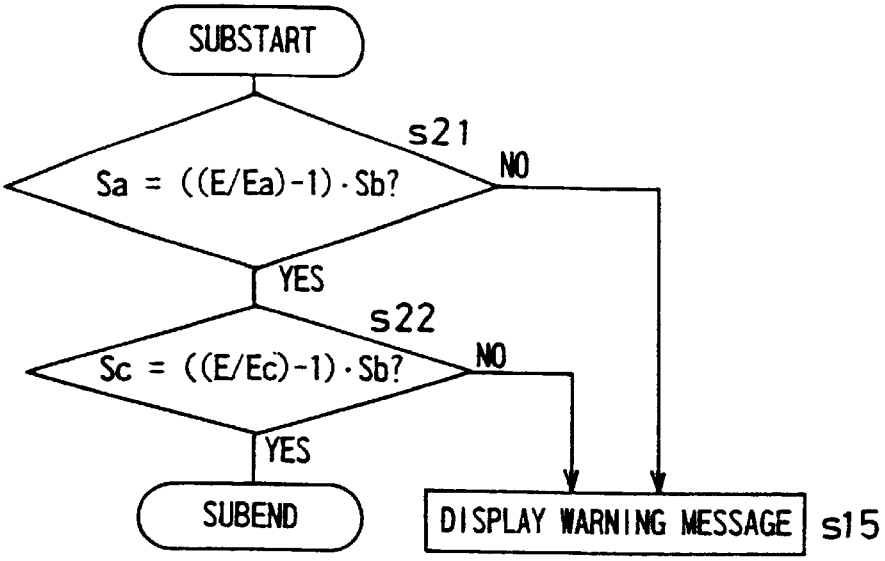
FIGS. 16A to 16C are flow charts of the above.
Figure 16B:
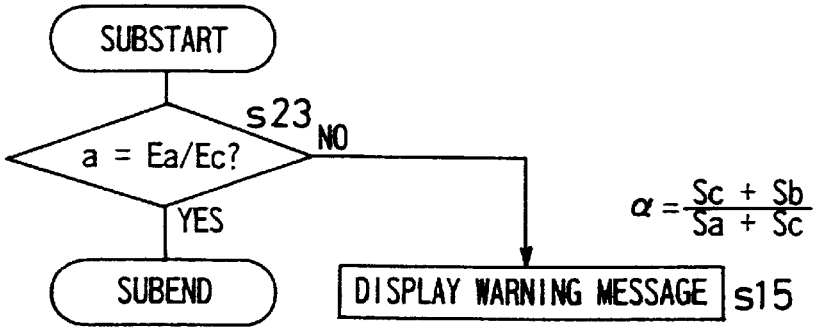
Figure 16C:
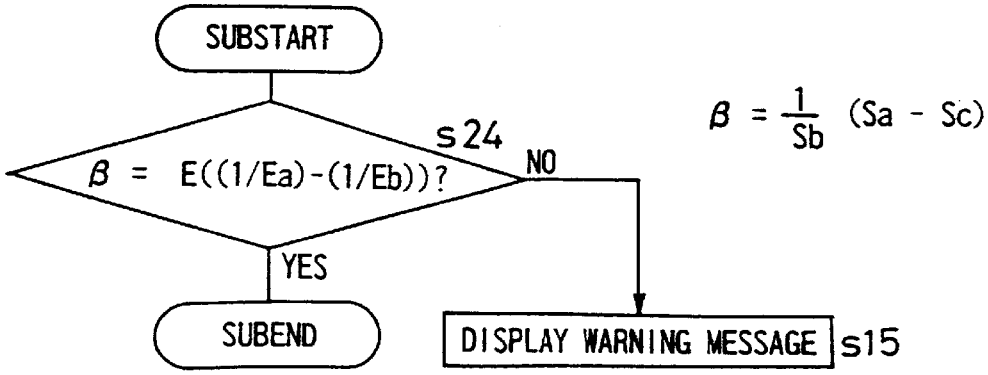

Here, assuming that, as shown in FIG. 14, the areas of the respective portions opposed to the partial electrode 31*a*, the partial electrode 31*b* and the electrode 32 in the pattern electrode 22 are Sa, Sb and Sc, the capacitances Ca to Cc are represented by:

$$Ca=\epsilon_0(\epsilon+\Delta\epsilon)\{Sa/(t+\Delta t)\}$$

$$Cb=\epsilon_0(\epsilon+\Delta\epsilon)\{Sb/(t+\Delta t)\}$$

$$Cc=\epsilon_0(\epsilon+\Delta\epsilon)\{Sc/(t+\Delta t)\}$$

wherein the dielectric constant in vacuum is $\epsilon_0$, the relative dielectric constant of the dielectric layer 21 is $\epsilon$, the error thereof is $\Delta\epsilon$, the thickness is t, and the error thereof is $\Delta t$. The values of the capacitances Ca to Cc are influenced by the error $\Delta\epsilon$ of the relative dielectric constant of the dielectric layer 21 and the error Δt of the thickness. However, in calculation of the detection voltages Ea and Eb by the expressions 1 and 2, the error Δε of the relative dielectric constant of the dielectric layer 21 and the error Δt of the thickness are offset, so that the detection voltages Ea and Eb are not influenced by the errors of the relative dielectric constant of the dielectric layer 21 and the thickness.

Therefore, with the configuration shown in FIGS. 12A and 12B, in the case of forming the recognizing portion 10 on the surface of the toner cartridge 9, even when errors are generated in the relative dielectric constant and thickness of the dielectric layer 21, it is possible to accurately detect electric signals from the recognizing portion 10 without being influenced by these errors.

FIGS. 15 and 16A to 16C are flow charts showing processing steps in the interchangeable part recognizing apparatus. When the toner cartridge 9, which is an interchangeable part, is mounted to the image forming section 1 of an image forming apparatus, which is a main unit (s1), the detecting section 11 firstly sets the frequency of the AC power source 16 to F1 (s2). After that, the detecting section applies an AC current from the AC power source 16 to the partial electrode 31*a* via the switching section 34 (s3), measures a detection voltage Ea of the partial electrode 31*a* via the partial electrode 31*b* (s4), and measures a current value Ia1 of the partial electrode 31*a* at the frequency F1 of the AC power source 16 (s5).

Furthermore, the detecting section 11 applies an AC voltage from the AC power source 16 to the partial electrode 31*b* via the switching section 34 (s6), and measures a detection voltage Eb of the partial electrode 31*b* via the partial electrode 31*a*. Subsequently, the detecting section 11 sets the frequency of the AC power source 16 to F2 in order to detect the change in capacitance or the change in dielectric loss in accordance with the applied frequency (s8). After that, the detecting section applies an AC voltage from the AC power source 16 to the partial electrode 31*a* via the switching section 34 (s9), and measures a current value Ia2 of the partial electrode 31*a* at the frequency F2 of the AC power source 16 (s10).

The detecting section 11 calculates the ratio between the current value Ia1 and the current value Ia2 of the partial electrode 31*a* as frequency characteristics FC (s11), and judges whether or not the frequency characteristics FC have changed in the range of predetermined values (s12). In the case where the frequency characteristics FC have changed within the predetermined values, the detecting section 11 executes area processing (s13), and judges whether the result of area processing is a predetermined value or not (s14). In the case where the frequency characteristics FC have not changed within the predetermined values, the detecting section judges that the mounted interchangeable part is not proper, and executes a warning process such as displaying a message to notice it (s15). The area processing at s13 and s14 will be detailed later.

In the case where the frequency characteristics FC have not changed at s12, or in the case where the result of area processing is a predetermined value at s14, the searching means 12 judges the kind of the interchangeable part based on the detection voltage Ea (s16). As mentioned before, in judgement of the kind of the interchangeable part, the searching means 12 judges whether or not the detection voltage Ea is stored in the first storing means 14. In the case where the detection voltage Ea is stored in the first storing means 14, the searching means reads out the kind of the interchangeable part stored so as to be associated with the detection voltage Ea, and supplies to the processing operation reading out means 13. The processing operation reading out means 13 reads a processing operation associated with the kind of the interchangeable part inputted from the searching means 12 out of the second storing section 15 (s17). The control section of the image forming apparatus controls the operations of the respective elements of the image forming section 1 based on the content of the processing operation read out by the processing operation reading out means 13, whereby a processing operation associated with the kind of the mounted interchangeable part is executed (s18).

In the case where the detection voltage Ea is not stored in the first storing means 14 at s16, the detecting section 11 judges that the mounted interchangeable part is not proper, and executes a warning process such as displaying a message to notice it (s19). Here, a message at the warning process of s15 and s19 is displayed on a display placed in an operation panel of the image forming apparatus, for example. The content of a message displayed here is, for example, "since the mounted interchangeable part is not genuine or proper, the life of the apparatus might be shortened".

Now, the area processing at s13 and s14 will be detailed. The contacting areas of the partial electrodes 31*a* and 31*b* constituting the detecting electrode to the recognizing portion 10 change in accordance with the shape of the pattern electrode 22 of the recognizing portion 10 to be opposed. The contacting area of the return electrode 32 to the recognizing portion 10 can be kept uniform regardless of the shape of the pattern electrode 22. Therefore, assuming that the area Sc of the return electrode 32 opposed to the recognizing portion 10 is a reference surface, it is judged whether the opposed areas Sa and Sb of the partial electrodes 31*a* and 31*b* to the pattern electrode 22 are proper or not. Specifically, it is judged whether the opposed area Sa of the partial electrode 31*a* to the pattern electrode 22 is $\{(E/Ea)-1\}\cdot Sb$ or not, and whether the opposed area Sb of the partial electrode 31*b* to the pattern electrode 31*b* is $\{(E/Eb)-1\}\cdot Sb$ or not (s21, s22).

On the contrary, in the case where the contacting area Sc of the return electrode 32 to the recognizing portion 10 changes, two judgement methods can be considered. In a first judgement method, it is judged whether or not the ratio a between the sum of the opposed area Sa of the partial electrode 31*a* and the opposed area Sc of the return electrode 32 and the sum of the opposed area Sb of the partial electrode 31*b* and the opposed area Sc of the return electrode 32 is equal to the ratio between the detection voltage Ea of the partial electrode 31*a* and the detection voltage Eb of the partial electrode 31*b*. That is to say, it is judged whether the following expression is satisfied or not:

$$\alpha=(Sb+Sc)/(Sa+Sc)=Ea/Eb$$

In a second judgement method, it is judged whether or not the ratio β of the difference between the opposed area Sa of the partial electrode 31*a* and the opposed area Sb of the partial electrode 31*b* to the opposed area Sc of the electrode 32 is equal to a value obtained by multiplying the difference between the reciprocal of the detection voltage Ea of the partial electrode 31*a* and the reciprocal of the detection voltage Eb of the partial electrode 31*b* by the AC voltage E. That is to say, it is judged whether the following expression is satisfied or not (s24):

$$\beta=(Sa-Sb)/Sb=E\cdot\{(1/Ea)-(1/Eb)\}$$

As described above, at the steps of s13 and s14 (s21 to s24), the area is calculated based on the ratio between the voltages Ea and Eb. Therefore, even in the case where the detection voltages Ea and Eb change as the voltage E changes, it is possible to calculate the area with high accuracy while canceling an effect of the change.

As described above, by changing the frequency of an AC voltage applied from the AC power source 16 to the detection electrode 31 and detecting electric signals for the recognizing portion 10, it is possible to use materials which have different frequency characteristics as a material for the dielectric layers 21 and 23 of the recognizing portion 10 in accordance with the kinds of interchangeable parts. Therefore, it is possible to largely increase the amount of information by combining information on the frequency characteristics and information on the electrode area.

Figure 17:
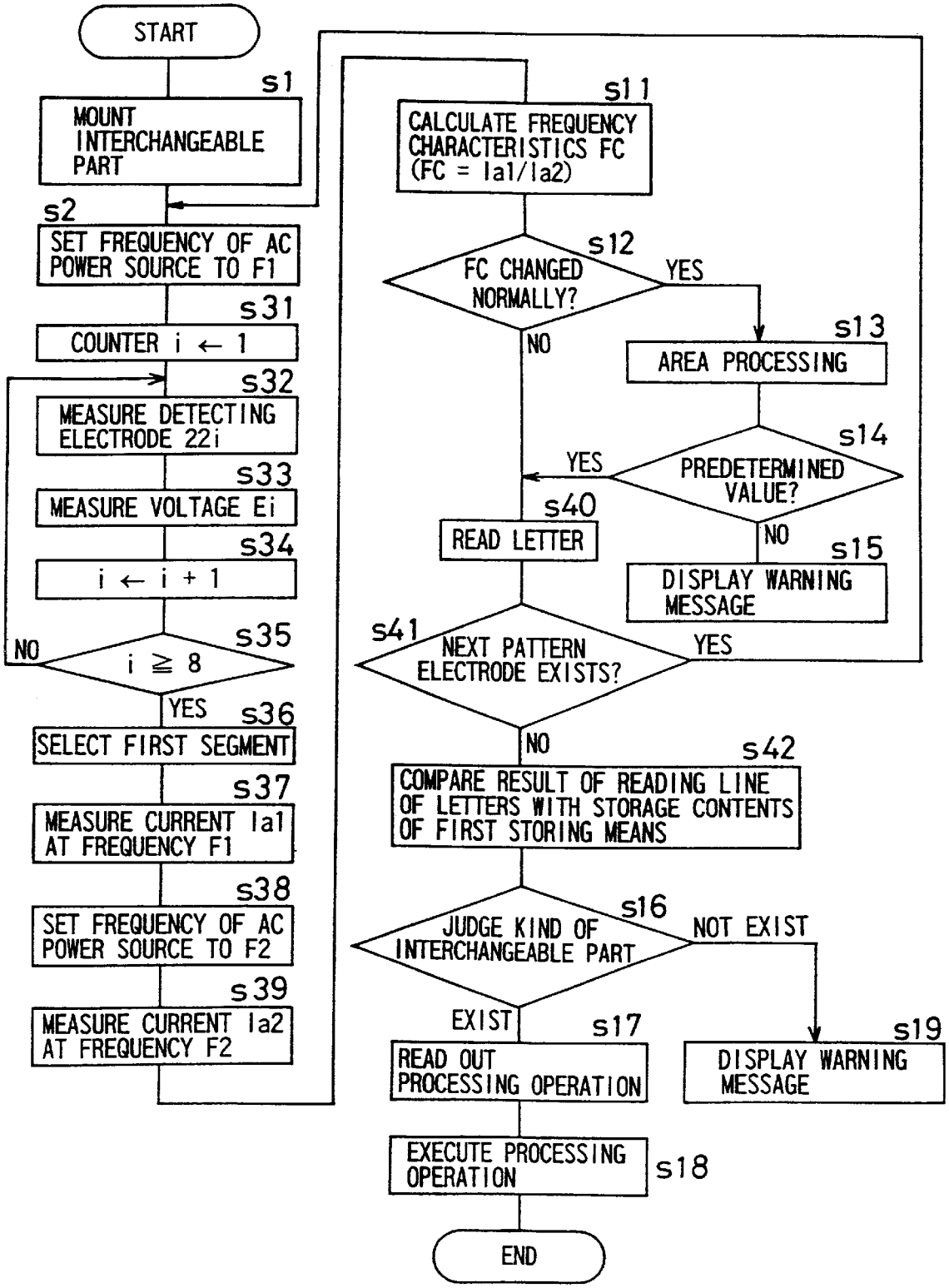
FIG. 17 is a flow chart showing processing steps of the interchangeable part recognizing apparatus in the case where the pattern electrode of the recognizing portion and the detecting electrode of the detecting section are formed by a plurality of segments.

FIG. 17 is a flow chart showing processing steps in the interchangeable part recognizing apparatus which is provided with the pattern electrode shown in FIG. 4 and the detecting electrode shown in FIG. 8. A single segment or a plurality of segments selected from the seven segments 22*a* to 22*g* form the plane shape of the pattern electrode 22. In the case where the detecting electrode 31 is composed of the seven segments 31*a* to 31*g*, the detecting section 11 executes the steps of s31 to s39 instead of the steps of s3 to s10 shown in FIG. 15, and executes the steps of s40 to s42 between the steps s12 and s16.

That is to say, after the toner cartridge 9, which is an interchangeable part, is mounted to the image forming section 1 of the image forming apparatus, which is a main unit, the detecting section 11 sets the frequency of the AC power source 16 to F1 (s2), and sets a counter i at a count value of 1 (s31). The counter i specifies the respective seven segments 31*a* to 31*g* constituting the detecting electrode 31 by the respective count values "1" to "7". Subsequently, after selecting a segment of the detecting electrode 31 specified by the count value of the counter i as a measurement object, the detecting section 11 connects the AC power source to the segment of the measurement object to measure a voltage Ei, and continuously executes a process of incrementing the count value of the counter i (s32 to s34) until the count value of the counter i becomes "8" (s35 to s32).

After that, the detecting section 11 selects a first segment at which any of the segments 22*a* to 22*g* of the associated pattern electrode 22 exists and a voltage of which was measured, from among the seven segments 31*a* to 31*g* constituting the detecting electrode 31, as a measurement object of a current value (s36). Subsequently, the detecting section 11 measures current values Ii1 and Ii2 at two kinds of frequencies F1 and F2 regarding the segment of measurement object selected at s36 (s37 to s39), and executes the steps of s11 to s15 shown in FIG. 17 based on the measurement result.

In the above processes, in the case where electrical characteristics of the seven segments 22*a* to 22*g* constituting the pattern electrode 22 are the same with each other, the detecting section 11 can judge whether the pattern electrode 22 is proper or not by calculating frequency characteristics of a single segment for one pattern electrode.

Furthermore, regarding the pattern electrode 22 judged to be proper based on the result of calculating frequency characteristics, the detecting section 11 reads a letter represented by the plane shape of the pattern electrode 22 in accordance with the configuration of the segment whose voltage Ei was measured (s40). The detecting section 11 executes the steps of s2 to s40 regarding all the pattern electrodes 22 constituting the recognizing portion 10 disposed to the interchangeable part, reads a line of letters written on the recognizing portion 10 (s41), and compares the reading result with storage contents of the first storing means (s42). The detecting section 11 judges the kind of the interchangeable part based on the comparison result, and executes a process associated with the judgement result (s16 to s19).

Here, in the case where all the seven segments 22*a* to 22*g* constituting the pattern electrode 22 are of the same shape, it is possible to immediately judge that an interchangeable part is not proper when frequency characteristics calculated at s11 are not proper. Therefore, the steps of s13 and 16 may be omitted.

Figure 18:
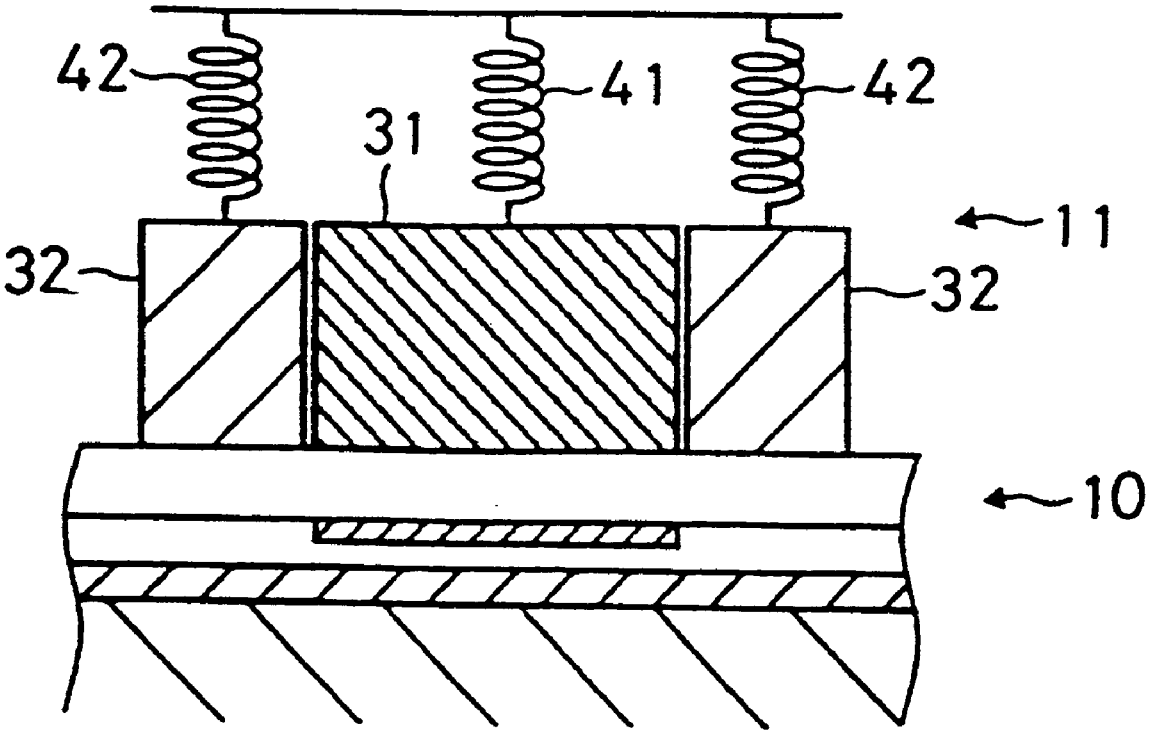
FIG. 18 is a view showing the configuration of an interchangeable part recognizing apparatus of still another embodiment of the invention.

FIG. 18 is a view showing the configuration of a detecting section included in an interchangeable part recognizing apparatus of still another embodiment of the invention. In the interchangeable part recognizing apparatus of the embodiment, the detecting section 11 includes elastic members 41 and 42 such as coil spring or polyurethane foam which have elasticity of pressing the detecting electrode 31 and the return electrode 32 against the recognizing portion 10. With this configuration, when an interchangeable part is mounted, the detecting electrode 31 and the return electrode 32 of the detecting section 11 are pressed against the surface of the recognizing portion 10 of the interchangeable part due to elasticity of the elastic members 41 and 42. Therefore, it is possible to increase the intimacy between the recognizing portion 10 and the detecting section 11, and detect electric signals with more accuracy.

This effect can also be obtained by forming the detecting electrode 31 and the return electrode 32 of the detecting section 11 with electrically conductive rubber which has conductivity, or forming the entire electrode 24 of the recognizing portion 10 on a board and mounting the board on the surface of an interchangeable part via an elastic member.

In the image forming apparatus, there is an interchangeable part such as a process cartridge made by removably uniting one or more of the charging means 3, the developing means 5 and the cleaning means 7 with the photoconductor drum 2, or a process cartridge made by removably uniting the above with a fixing section and an optical system. In these cases, other than the toner cartridge 9, two or more interchangeable parts like a process cartridge exist. In the case where a plurality of interchangeable parts exist is a single main unit, it is possible to share the detecting section 11 excluding the detecting electrode 31 and the return electrode 32, the searching means 12, the process operation read out means 13, the first storing means and the second storing means, among the plurality of interchangeable parts.

Further, in an interchangeable part recognizing apparatus in which the toner cartridge 9 mounted to the developing means 5 of the image forming section 1 is an interchangeable part, information electrically recognized based on electric signals detected from the recognizing portion 10 is a developing condition of toner contained in the toner cartridge 9, the color of the toner, a charging condition of the photoconductor, an exposing condition of the photoconductor or the like. By recognizing such information, it is possible to optimize a process condition at the time of image forming in accordance with toner contained in the toner cartridge 9.

Thus, according to the interchangeable part recognizing apparatus of the invention, a processing operation in a main unit would not be executed in a state where an improper interchangeable part is mounted to the main unit. Therefore, it is possible to suppress malfunction and failure of the main unit. Specifically, as a result of applying the interchangeable part recognizing apparatus of the embodiment to an image forming apparatus, it is possible to not only avoid deterioration of image quality resulting from an image forming process executed in a state where an improper toner cartridge 9 is mounted to the developing means 5 of the image forming section 1, but also optimize an image forming process condition in accordance with toner contained in a mounted toner container 9, thereby increasing image quality.

Further, since being configured plane in the interchangeable part recognizing apparatus of the invention, the recognizing portion and the detecting section can meet changes of the specification of an interchangeable part more easily than the recognizing portion and the detecting section configured three-dimensional. For example, in the image forming apparatus, in the case of making a toner cartridge contain new composition of toner in order to improve image quality, there is no need to change the shape of the toner cartridge itself and the shape of the detecting section.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An interchangeable part recognizing apparatus, comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode; and an electric signal at the time of applying the AC voltage of the AC power source to the recognizing portion via the detecting electrode is detected as information on the interchangeable part.

2. The interchangeable part recognizing apparatus of claim 1, wherein the pattern electrode is of a specific shape including an ideographic shape having a predetermined logo mark or letter, formed into a plane shape which is the same in basic shape regardless of a kind of the interchangeable part and different in area depending on the kind of the interchangeable part.

3. The interchangeable part recognizing apparatus of claim 1, wherein the dielectric layer is composed of a first dielectric layer which covers the top surface of the pattern electrode and a second dielectric layer which is placed between the entire electrode and the pattern electrode.

4. The interchangeable part recognizing apparatus of claim 1, wherein the detecting section includes a return electrode which has a shape to surround the periphery of the detecting electrode.

5. The interchangeable part recognizing apparatus of claim 1, wherein the detecting electrode is elastically supported and contacts the recognizing portion.

6. The interchangeable part recognizing apparatus of claim 1, wherein the main unit includes a storing section in which a relationship between electric signals to be detected by the detecting section and information on a processing operation to be executed by the main unit for each of plural kinds of interchangeable parts which can be mounted to the main unit is stored, and a searching section which searches, in the storing section, a processing operation corresponding to electric signals detected from the recognizing portion by the detecting section.

7. An interchangeable part recognizing apparatus comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode having a plane shape, which is composed of at least one segment made effective selectively from among a plurality of segments of identical or different shape, an entire electrode which is located between a surface of the interchangeable part and the pattern electrode and extended in a wider range than the pattern electrode, and a light-transmitting dielectric layer which covers whole of a top surface of the pattern electrode and at least a part of a top surface of the entire electrode, the part being opposed to the pattern electrode;

the detecting section has a shape corresponding to the plane shape of the pattern electrode, and includes a detecting electrode which is electrically connected to the recognizing portion, and an AC power source which applies an AC voltage to the detecting electrode; and an electric signal at the time of applying the AC voltage of the AC power source to the recognizing portion via the detecting electrode is detected as information on the interchangeable part.

8. The interchangeable part recognizing apparatus of claim 7, wherein the pattern electrode has a plane ideographic shape having a predetermined logo mark or letter, which ideographic plane shape is composed of at least one segment selected from among a plurality of segments of identical or different shape and made effective.

9. The interchangeable part recognizing apparatus of claim 7, wherein the pattern electrode has a plane shape which is composed of at least one segment of seven segments constituting a letter of "□".

10. The part recognizing apparatus of claim 7, wherein the pattern electrode has a plane ideographic shape including a predetermined logo mark or letter as a specific shape, which plane ideographic shape is composed of at least one segment of seven segments constituting a letter of "□".

11. The interchangeable part recognizing apparatus of claim 7, wherein the dielectric layer is composed of a first dielectric layer which covers the top surface of the pattern electrode and a second dielectric layer which is placed between the entire electrode and the pattern electrode.

12. The interchangeable part recognizing apparatus of claim 7, wherein the detecting section includes a return electrode which has a shape to surround the periphery of the detecting electrode.

13. The interchangeable part recognizing apparatus of claim 7, wherein the main unit includes a storing section in which a relationship between electric signals to be detected by the detecting section and information on a processing operation to be executed by the main unit for each of plural kinds of interchangeable parts which can be mounted to the main unit is stored, and a searching section which searches, in the storing section, a processing operation corresponding to electric signals detected from the recognizing portion by the detecting section.

14. An interchangeable part recognizing apparatus, comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode;

an electric signal at the time of applying the AC voltage of the AC power source to the recognizing portion via the detecting electrode is detected as information on the interchangeable part;

the detecting section includes a return electrode which has a shape to surround the periphery of the detecting electrode; and the return electrode is electrically connected to the entire electrode directly or via the dielectric layers.

15. The interchangeable part recognizing apparatus of claim 14, wherein the detecting electrode is divided into a plurality of portions associated with the plane shape of the pattern electrode.

16. An interchangeable part recognizing apparatus, comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode;

an electric signal at the time of applying the AC voltage of the AC power source to the recognizing portion via the detecting electrode is detected as information on the interchangeable part; and the detecting electrode is divided into a plurality of portions associated with the plane shape of the pattern electrode, the apparatus further comprising:

a comparing section for comparing electric signals detected by the plurality of portions of the detecting electrode.

17. An interchangeable part recognizing apparatus, comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode;

an electric signal at the time of applying the AC voltage of the AC power source to the recognizing portion via the detecting electrode is detected as information on the interchangeable part;

the detecting electrode is divided into a plurality of portions associated with the plane shape of the pattern electrode; and the detecting section alternately applies an AC voltage to two portions divided in the detecting electrode and, during application of an AC voltage to one of the two portions, detects electric signals via the other portion to which an AC voltage is not applied.

18. An interchangeable part recognizing apparatus, comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode;

an electric signal at the time of applying the AC voltage of the AC power source to the recognizing portion via the detecting electrode is detected as information on the interchangeable part;

the return electrode is electrically connected directly or via the dielectric layer to the entire electrode; and the return electrode is a reference surface of constant area.

19. The interchangeable part recognizing apparatus of claim 18, wherein the AC power source includes frequency changing means which changes the frequency of an AC voltage applied to the detecting electrode.

20. The interchangeable part recognizing apparatus of claim 18, wherein the detecting electrode is elastically supported and contacts the recognizing portion.

21. An interchangeable part recognizing apparatus, comprising:

a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode;

an electric signal at the time of applying the AC voltage of the AC power source to the recognizing portion via the detecting electrode is detected as information on the interchangeable part;

the detecting electrode itself is elastic; and the detecting electrode is elastically supported and contacts the recognizing portion.

22. The interchangeable part recognizing apparatus of claim 21, wherein the detecting electrode is formed of an electrically conductive rubber.

23. An image forming apparatus which is provided with the interchangeable part recognizing apparatus comprising a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode formed into a specific plane shape, an entire electrode which is located between the surface of the interchangeable part and the pattern electrode and extended in a wider range than the pattern electrode, and a light-transmitting dielectric layer which covers a whole surface of the pattern electrode and at least a part of a top surface of the entire electrode, the part being opposed to the pattern electrode;

the detecting section is of a shape corresponding to the plane shape of the pattern electrode, and includes a detecting electrode which is electrically connected to the recognizing portion, and an AC power source which applies an AC voltage to the detecting electrode; and an electric signal at the time of applying the AC voltage of the AC power source to the recognizing portion via the detecting electrode is detected as information on the interchangeable part.

24. The image forming apparatus of claim 23, wherein the interchangeable part recognizing apparatus uses a toner cartridge including a toner replenishing bottle as an interchangeable part.

25. The image forming apparatus of claim 23, wherein the interchangeable part recognizing apparatus uses, as an interchangeable part, a process cartridge which includes the photoconductor and at least one of the developing means, the charging means and the cleaning means constituting the image forming section.

26. An image forming apparatus which is provided with an interchangeable part recognizing apparatus comprising a recognizing portion formed on a surface of an interchangeable part which is removably mounted to a main unit, for displaying information on the interchangeable part; and a detecting section for reading the information from the recognizing portion of the interchangeable part mounted to the main unit, wherein the recognizing portion includes a pattern electrode having a plane shape, which is composed of at least one segment made effective selectively from among a plurality of segments of identical or different shape, an entire electrode which is located between a surface of the interchangeable part and the pattern electrode and extended in a wider range than the pattern electrode, and a light-transmitting dielectric layer which covers whole of a top surface of the pattern electrode and at least a part of a top surface of the entire electrode, the part being opposed to the pattern electrode;

the detecting section has a shape corresponding to the plane shape of the pattern electrode, and includes a detecting electrode which is electrically connected to the recognizing portion, and an AC power source which applies an AC voltage to the detecting electrode; and an electric signal at the time of applying the AC voltage of the AC power source to the recognizing portion via the detecting electrode is detected as information on the interchangeable part.

27. The image forming apparatus of claim 26, wherein the interchangeable part recognizing apparatus uses a toner cartridge including a toner replenishing bottle as an interchangeable part.

28. The image forming apparatus of claim 26, wherein the interchangeable part recognizing apparatus uses, as an interchangeable part, a process cartridge which includes the photoconductor and at least one of the developing means, the charging means and the cleaning means constituting the image forming section.

* * * * *